US007301517B2

(12) United States Patent
Hebiguchi et al.

(10) Patent No.: US 7,301,517 B2
(45) Date of Patent: Nov. 27, 2007

(54) LIQUID-CRYSTAL DISPLAY APPARATUS CAPABLE OF REDUCING LINE CRAWLING

(75) Inventors: Hiroyuki Hebiguchi, Miyagi-ken (JP); Akira Nakano, Miyagi-ken (JP); Yukimitsu Yamada, Miyagi-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 485 days.

(21) Appl. No.: 10/434,951

(22) Filed: May 8, 2003

(65) Prior Publication Data

US 2003/0210218 A1 Nov. 13, 2003

(30) Foreign Application Priority Data

May 10, 2002 (JP) ..... 2002-135712
May 13, 2002 (JP) ..... 2002-137630
Jul. 4, 2002 (JP) ..... 2002-195828

(51) Int. Cl.
*G09G 3/36* (2006.01)

(52) U.S. Cl. ..... 345/90; 345/60; 345/96

(58) Field of Classification Search ..... 345/87–88, 345/89–90, 93, 151, 30; 349/138–9, 142–4
See application file for complete search history.

(56) References Cited

U.S. PATENT DOCUMENTS 5,805,250 A * 9/1998 Hatano et al. ..... 349/96
6,232,938 B1 * 5/2001 Tsuchida et al. ..... 345/88
6,249,326 B1 6/2001 Hebiguchi
6,323,871 B1 11/2001 Fujiyoshi et al.
6,335,778 B1 * 1/2002 Kubota et al. ..... 349/151
6,529,180 B1 * 3/2003 Ito et al. ..... 345/89
6,756,953 B1 * 6/2004 Tokioka et al. ..... 345/87
6,768,482 B2 * 7/2004 Asano et al. ..... 345/90
2002/0075206 A1 * 6/2002 Takeda et al. ..... 345/60

* cited by examiner

*Primary Examiner*—Sumati Lefkowitz
*Assistant Examiner*—Tammy Pham
(74) *Attorney, Agent, or Firm*—Beyer Weaver LLP

(57) ABSTRACT

In a liquid-crystal display apparatus, each color pixel has three dots enclosed by adjacent signal lines and adjacent scanning lines. Each dot is provided with a switching device and a dot electrode. Each color pixel is provided with three display electrodes electrically connected to three dot electrodes through contact holes passing through an insulation layer. The display electrodes are disposed so as to overlap with the three dot electrodes. Each of the display electrodes is electrically connected to only one of the three dot electrodes. Each of the dot electrodes is electrically connected to only one of the display electrodes.

4 Claims, 31 Drawing Sheets

FIG. 20B

| G1_SEL0 | G1_SEL1 | (1) | (2) | (3) |
|---|---|---|---|---|
| HIGH | HIGH | ON | OFF | OFF |
| LOW | HIGH | OFF | ON | OFF |
| HIGH | LOW | OFF | OFF | ON |
| LOW | LOW | OFF | OFF | OFF |

FIG. 23B

| G1_SEL0 | G1_SEL1 | G1_SEL2 | (1) | (2) | (3) |
|---|---|---|---|---|---|
| HIGH | HIGH | LOW | ON | OFF | OFF |
| LOW | HIGH | HIGH | OFF | ON | OFF |
| HIGH | LOW | HIGH | OFF | OFF | ON |
| LOW | LOW | LOW | OFF | OFF | OFF |

LIQUID-CRYSTAL DISPLAY APPARATUS CAPABLE OF REDUCING LINE CRAWLING

BACKGROUND OF THE INVENTION

1. Field of the Invention

The present invention relates to liquid-crystal display apparatuses, and more particularly, to liquid-crystal display apparatuses employing an active-matrix addressing method.

2. Description of the Related Art

In color liquid-crystal display (hereinafter called LCD in some cases) apparatuses which employ an active-matrix addressing method, a plurality of color pixels, each showing one color by combining a number of basic colors, are arranged in a matrix. The color pixels are matrix-addressed with scanning lines (gate buses) and signal lines (source buses).

A technology has been proposed for such LCD apparatuses, in which a combination of basic colors, such as the three primary colors, red (R), green (G), and blue (B), is repeatedly arranged in a direction along each signal line. The number of the signal lines is set to the number of the basic colors multiplied by the number of pixels in the direction along a signal line. The number of the basic colors is typically set to three. A scanning line method employing such a structure is generally referred to as a "tripled scanning line method." In conjunction with tripled scanning line method, another method, referred to as 3:1 interlaced driving, is sometimes employed. In 3:1 interlaced driving, only one in every third line of a display is scanned at a time.

In a tripled scanning line method, the number of gate drivers is three times as large as that used in a conventional scanning line method. However, source drivers consume more power and are more expensive than the gate drivers. Therefore, the power consumption of using a tripled scanning line method is cut to one-third the power consumption of using a single scanning line method and the cost of the LCD apparatus is commensurately reduced.

The use of the 3:1 interlaced driving also reduces the power consumption of a LCD apparatus. In 3:1 interlaced driving, the frame frequency (frequency at which one entire screen is rewritten) is cut to one-third compared to using conventional interlaced driving.

There are some drawbacks, however, of using 3:1 interlaced driving methods. Due to the reduced frame frequency, for example, movement becomes less smooth in some cases when moving images are displayed. This display unevenness is referred to as "line crawling."

In general, liquid-crystal polarity inversion driving methods include dot inversion methods, which emphasize image quality, and common inversion methods, which emphasize power reduction. Dot inversion methods reduce line crawling by reducing the distance D between lines when dots having the same primary color (such as G among R, G, and B) being driven by the same-polarity driving voltage are connected to each other. For example, in a LCD apparatus that has a viewing distance of 30 cm, the line distance D is preferably 260 μm or shorter. In this example, line crawling can be reduced when dot inversion driving is used,.

A system which employs the tripled scanning line method and interlaced driving, described above, is suited to portable terminals and other devices where power reduction and low cost are of concern but motion-image display performance is less of a concern. In such a system, it is preferred that the common inversion method be used since it is more effective for reducing power than the dot inversion method.

The use of common inversion driving, however, can be problematic in some cases when it is employed in conjunction with 3:1 interlaced driving and tripled-scanning-line-methods. For example, problems can occur if the distance D between a plurality of lines obtained when dots having the same basic color and being driven by the same-polarity driving voltage are connected to each other in their vicinities is 6P (where P indicates the pitch of color pixels each formed of three dots).

FIG. 29 is a view for explaining the above, and shows dots arranged in a matrix manner in 30 rows. Letters A, B, and C placed at the left-hand side of the figure indicate write timing in 3:1 interlaced driving. For example, first, data is sequentially written into rows having A from the top to the bottom, then, data is sequentially written into rows having B from the top to the bottom, and finally, data is sequentially written into rows having C from the top to the bottom. Since R, G, and B are arranged periodically in the vertical direction, the rows having A, B, and C are not periodically arranged so as to prevent only the same basic color from being always written at timing A. In common inversion driving, all dots arranged in each row horizontally have the same polarity. When the basic colors, R, G, and B, are arranged in that order repeatedly from the top row to the bottom row in FIG. 29, the fifth row has negative-polarity G dots written at timing A, and the next negative-polarity G dots appear at the 23rd row. Therefore, the line distance D corresponds to 18 dots, that is, six pixels.

The color pixel pitch P is, for example, 127 μm at a pixel density of 200 pixel per inch (ppi), which is generally said to be a high definition. The corresponding line distance D is D=6P=762 μm. The line distance D is long enough to visually recognize line crawling. In a 3.5-inch QVGA (320 by 240 pixels) display unit, which is popular for current portable terminals, P is 223.5 μm and D=6P=1,341 μm, which will undoubtedly result in recognized line crawling. Conversely, to set the line distance D to 260 μm or shorter, the color pixel pitch needs to be 43 μm or less, which is currently difficult to produce in the making of high-pixel-density display units.

In other words, when common inversion driving is employed together with the conventional tripled-scanning line method, it is difficult to apply a sufficient countermeasure to line crawling.

When dot inversion driving is employed, which reduces line crawling, adjacent dots arranged in each row horizontally have opposite polarities as shown in FIG. 28, unlike common inversion driving. In this case, the line distance D is 1.9P. At a pixel density of 200 ppi (P=127 μm), D is 241.3 μm, which is shorter than 260 μm. Thus, an effective countermeasure against line crawling can be implemented. In dot inversion driving, however, the signal amplitude is about twice that used in common inversion driving. Therefore, power consumption increases since the power consumption of using only source drivers is about four times as large as in common inversion driving.

SUMMARY OF THE INVENTION

The present invention has been made to solve the foregoing issues. It is an object of the present invention to provide a liquid-crystal display apparatus having a good image quality by making use of a plural-fold scanning line method and by substantially reducing line crawling. Further, it is another object of the present invention to provide a liquid-crystal display apparatus having the above qualities and which is capable of reducing power consumption.

When common inversion driving is employed, the spatial frequency of flicker becomes low. As a countermeasure against line crawling caused by the reduced spatial frequency, a technology has been proposed in which the arrangement of R (red); G (green), and B (blue) color filters is changed from a horizontal stripe to a horizontal mosaic to make the spatial frequency of flicker higher, so that line crawling is difficult to visually recognize. With this technology, line crawling is reduced, but a black straight horizontal line has ridges and it is not visually recognized as a straight line.

The present invention has been made to solve the foregoing issue, and it is an object of the present invention to provide a liquid-crystal display apparatus having a low power consumption by the use of technologies such as common inversion driving and a plural-fold scanning line method, having line crawling (flicker) which is difficult to visually recognize, and having neither ridges nor steps on a black straight line.

The foregoing objects are achieved in a first aspect of the present invention by providing a liquid-crystal display apparatus characterized in that liquid crystal is sandwiched between a pair of substrates oppositely disposed, a plurality of signal lines and a plurality of scanning lines are provided in a matrix manner on one of the pair of substrates, and a plurality of pixels each having a plurality of different basic colors. Each pixel has the same number of dots as the number of the basic colors, enclosed by adjacent signal lines and adjacent scanning lines. Each dot has a switching device electrically connected to a scanning line and a signal line, and a first electrode electrically connected to the switching device. Each pixel is provided with the same number of second electrodes as the number of the basic colors, the second electrodes being formed on an insulation layer which covers the first electrodes and being electrically connected to the first electrodes through contact holes passing through the insulation layer. Each of the second electrodes is disposed over the same number of the first electrodes as the number of the basic colors. Each of the second electrodes is electrically connected to only one of the same number of the first electrodes as the number of the basic colors, and each of the first electrodes is electrically connected to only one of the second electrodes.

In the liquid-crystal display apparatus according to the first aspect of the present invention, since the first electrodes are electrically connected to the signal lines through the switching devices, and the first electrodes and the second electrodes disposed thereabove are electrically connected to the signal lines through the contact holes, image signals are written into the second electrodes from the first electrodes through the contact holes, and the second electrodes drive the liquid crystal. In other words, the second electrodes drive the liquid crystal to directly contribute to displaying. In this structure, when the positions where the contact holes are made are appropriately selected, second electrodes to which image signals are written at the same time by the same scanning line are selected, and basic colors written at the same time when interlaced driving is performed are selected. In other words, timing at which a signal is written into each dot and the planar arrangement of displayed basic colors can be independently determined. As a result, basic-color arrangement does not need to be a complicated arrangement, such as mosaic arrangement, and an effective countermeasure against line crawling can be applied. When non-interlaced (progressive) driving is performed, which does not cause line crawling, if second electrodes to which signals are written at the same time by the same scanning line are set to have the same basic color, it becomes easy to apply image processing such as image interpolation and contour emphasis.

In the liquid-crystal display apparatus according to the first aspect of the present invention, it is preferred that one frame be divided into at least the same number of fields as the number of the basic colors, interlaced driving be performed, and the rates of the basic colors corresponding to second electrodes to which signals are written in each field be substantially the same.

Since the basic structure according to the present invention described above has an increased effect on reducing line crawling, when the ratio of the interlaced scanning is increased to a level where line crawling is tolerable, and the frame frequency is reduced to a minimum level where line crawling is tolerable, a reduction in power consumption is made maximum. If color balance in one field brakes, flicker may be seen in the entire screen. This flicker in the entire screen can be prevented from occurring by making the rates of the basic colors corresponding to second electrodes to which signals are written in each field almost the same to hold color balance.

It is also preferred that the rates of the basic colors corresponding to second electrodes electrically connected to the same scanning line be almost the same. It is further preferred that the basic colors corresponding to adjacent second electrodes electrically connected to the same scanning line be different from each other.

With these structures, an enhanced effect on reducing line crawling is obtained. Especially, the latter structure is more preferred.

In the liquid-crystal display apparatus according to the first aspect of the present invention, it is preferred that common inversion driving be employed. In addition, it is preferred that the liquid-crystal display apparatus is a reflective liquid-crystal display apparatus.

With the user of common inversion driving, power saving, which is a feature obtained when a plural-fold scanning-line method and interlaced driving are used, is further enhanced. In a reflective liquid-crystal display apparatus, since a backlight is not required, power saving is promoted. These structures are very suitable for portable terminals and others.

It is preferred that the basic colors are three primary colors, red, green, and blue.

With this structure, color reproduction is enhanced with the least necessary number of basic colors.

It is preferred that the basic colors be arranged in a stripe manner.

With this structure, no adverse effects are obtained on displaying. A horizontal or vertical straight line does not have ridges, and a displayed pattern does not have subtle coloring at ends. The structure is suited to display on the screen of a personal computer.

The foregoing objects are achieved in a second aspect of the present invention through the provision of a liquid-crystal display apparatus characterized in that liquid crystal is sandwiched between a pair of substrates oppositely disposed, a plurality of signal lines and a plurality of scanning lines are provided in a matrix manner on one of the pair of substrates, and a plurality of pixels each having a plurality of different basic colors is provided; each pixel has the same number of dots as the number of the basic colors, enclosed by adjacent signal lines and adjacent scanning lines, and each dot has a switching device electrically connected to a scanning line and a signal line, and a first electrode electrically connected to the switching device; each pixel is provided with the same number of second electrodes as the number of the basic colors, the second electrodes being formed on an insulation layer which covers the first electrodes and being electrically connected to the first electrodes through contact holes passing through the insulation layer, each of the second electrodes is disposed over the same number of the first electrodes as the number of the basic colors, each of the second electrodes is electrically connected to only one of the same number of the first electrodes as the number of the basic colors, and each of the first electrodes is electrically connected to only one of the second electrodes; and the switching devices and the second electrodes are not stacked over one another in the process layer stack of the apparatus.

In the liquid-crystal display apparatus according to the first aspect of the present invention, among second electrodes, some second electrodes overlap with switching devices vertically. At some positions, switching devices exist below second electrodes. Therefore, the capacitances of the parasitic capacitors formed between second electrodes and switching devices vary among the second electrodes. Consequently, the offset voltage varies among a plurality of second electrodes. The dispersion of the offset voltage does not cause a large problem when the apparatus is designed such that the permittivity of an inter-layer insulation film formed between the second electrodes and the switching devices is reduced or the film thickness is thickened to reduce the capacitances of the parasitic capacitors to suppress the absolute value of the dispersion of the capacitors of the parasitic capacitors, or such that the capacitance of a holding capacitor is increases to make the absolute value of the dispersion of the capacitances of the parasitic capacitors fall in a tolerable range for the capacitance of the holding capacitor. When an attempt is made to increase a pixel density, however, it is difficult to have the above-described design conditions. In some cases, flicker or burning occurs.

In the liquid-crystal display apparatus according to the second aspect of the present invention, since the switching devices and the second electrodes are disposed so as not to overlap vertically, the capacitances of the parasitic capacitors formed by the second electrodes and the switching devices are reduced, and the dispersion of the offset voltages for the plurality of second electrodes is reduced. As a result, display problems such as flicker and burning are alleviated while design flexibility is maintained. Specific example liquid-crystal display apparatuses in applications already filed and specific example liquid-crystal display apparatuses according to the present invention will be described in Description of the Preferred Embodiments.

The foregoing objects are achieved in a third aspect of the present invention through the provision of a liquid-crystal display apparatus characterized in that liquid crystal is sandwiched between a pair of substrates oppositely disposed, a plurality of signal lines and a plurality of scanning lines are provided in a matrix manner on one of the pair of substrates, and a plurality of pixels each having a plurality of different basic colors is provided; each pixel has the same number of dots as the number of the basic colors, enclosed by adjacent signal lines and adjacent scanning lines, and each dot has a switching device electrically connected to a scanning line and a signal line, and a first electrode electrically connected to the switching device; each pixel is provided with the same number of second electrodes as the number of the basic colors, the second electrodes being formed on an insulation layer which covers the first electrodes and being electrically connected to the first electrodes through contact holes passing through the insulation layer, each of the second electrodes is disposed over the same number of the first electrodes as the number of the basic colors, each of the second electrodes is electrically connected to only one of the same number of the first electrodes as the number of the basic colors, and each of the first electrodes is electrically connected to only one of the second electrodes; and in each pixel, at least one of a plurality of switching devices and one of the plurality of second electrodes are disposed so as to overlap vertically, and the number of switching devices which overlap with each second electrode is the same for all the second electrodes.

The liquid-crystal display apparatus according to the third aspect of the present invention differs from the liquid-crystal display apparatus according to the second aspect of the present invention in that one of the plurality of switching devices and one of the plurality of second electrodes overlap vertically in each pixel. Since the number of switching devices which overlap with each second electrode is the same for all second electrodes, the dispersion of the capacitances of the parasitic capacitors formed by the second electrodes and the switching devices is suppressed, and hence, the dispersion of the offset voltages is also suppressed. As a result, the same advantages as in the liquid-crystal display apparatus according to the second aspect of the present invention are obtained, in which display problems such as flicker and burning are alleviated while design flexibility is maintained.

Since it is necessary to arrange the switching devices and the second electrodes so as not to overlap with each other in the liquid-crystal display apparatus according to the second aspect of the present invention, the distance between adjacent second electrodes varies between areas where switching devices exist and areas where no switching devices exist, which means there are color areas having a long distance and color areas having a short distance. As a result, interference with threads of a light guide plate causes moiré in cases such as a case in which a front light is placed on the upper surface of the liquid-crystal display apparatus to make the apparatus have an unattractive appearance. In addition, since places where switching devices are disposed cannot contribute to displaying, an area (aperture ratio) for display becomes small, and an image is darkened. Contrarily, in the liquid-crystal display apparatus according to the third aspect of the present invention, since the structure is used in which the switching devices and the second electrodes overlap, the portions sandwiched by the second electrodes, which cannot be used for display, can be narrowed to have the same width. Therefore, an attractive-looking, bright image can be displayed.

It is preferred that the signal lines in the liquid-crystal display apparatus according to the third aspect of the present invention have, for example, one of the following three forms.

(1) In each dot, a signal sub-line branched from each signal line and extending to an end of the dot in the direction in which the scanning lines are extended is provided, and the switching device provided for the dot is electrically connected to the signal sub-line.

With this structure, since all the second electrodes have almost the same area where each second electrode overlap with the signal sub-line, the dispersion of the capacitances of the parasitic capacitors are further suppressed to improve display quality more.

(2) In each pixel, a signal sub-line extending over a plurality of dots in the pixel like stairs is provided, and a plurality of switching devices provided for the pixel is electrically connected to the signal sub-line.

Also with this structure, in the same way as described above, since all the second electrodes have almost the same area where each second electrode overlap with the signal sub-line, the dispersion of the capacitances of the parasitic capacitors are further suppressed to improve display quality more. In addition, with the present structure, the area where each second electrode overlap with the signal sub-line is made smaller than in the above-described structure because the signal sub-line has a shape like stairs. Therefore, the absolute values of the capacitances of the parasitic capacitors is further reduced.

(3) The same number of signal lines as the number of the basic colors are provided in parallel, the signal lines corresponding to the same number of dots as the number of the basic colors, which constitute one pixel, and ends of the same number of signal lines as the basic colors are electrically connected. In other words, the signal line corresponding to one pixel is divided at its root into the same number of lines as the number of the basic colors.

With this structure, all parasitic capacitors related to the second electrodes, including not only those caused by the switching devices and signal sub-line but also those formed by the signal main lines and the second electrodes, are made to have the same capacitance. Therefore, the dispersion of the capacitances of the parasitic capacitors is minimum among the three forms of the signal line.

The foregoing objects are achieved in a fourth aspect of the present invention through the provision of a liquid-crystal display apparatus characterized in that liquid crystal is sandwiched between a pair of substrates oppositely disposed, a plurality of signal lines and a plurality of scanning lines are provided on one of the pair of substrates, the plurality of scanning lines is divided into a plurality of scanning-line groups each formed of a plurality of scanning lines, and a plurality of pixels each having a plurality of different basic colors is provided; each pixel has the same number of dots as the number of the basic colors, enclosed by adjacent signal lines and adjacent scanning lines, and each dot has a thin-film transistor driven by one of the signal lines and a plurality of scanning lines constituting a scanning-line group, a dot electrode electrically connected to the thin-film transistor, and a selection circuit having a plurality of inputs and one output, connected between the thin-film transistor and the scanning-line group; the plurality of inputs of the selection circuit are respectively connected to different scanning lines of the plurality of scanning lines constituting the scanning-line group, and the output of the selection circuit is connected to the gate electrode of the thin-film transistor; and the thin-film transistor of one dot and the thin-film transistor of a dot adjacent thereto are scanned in different periods.

The foregoing objects are achieved in a fifth aspect of the present invention through the provision of a liquid-crystal display apparatus characterized in that liquid crystal is sandwiched between a pair of substrates oppositely disposed, a plurality of signal lines and a plurality of scanning lines are provided on one of the pair of substrates, the plurality of scanning lines is divided into a plurality of scanning-line groups each formed of a plurality of scanning lines, and a plurality of pixels each having a plurality of different basic colors is provided; each pixel has the same number of dots as the number of the basic colors, enclosed by adjacent signal lines and adjacent scanning lines, and each dot has a thin-film-transistor set driven by one of the signal lines and one of a plurality of scanning lines constituting a scanning-line group, and a dot electrode electrically connected to the thin-film-transistor set; the thin-film-transistor set in each dot includes a plurality of thin-film transistors connected in series between the signal line and the dot electrode, the number of the plurality of thin-film transistors being smaller than the number of scanning lines constituting a scanning-line group, the gate electrodes of the plurality of thin-film transistors are respectively connected to different scanning lines of the plurality of scanning lines constituting the scanning-line group, and a combination of the connections between the gate electrodes of the plurality of thin-film transistors and the plurality of scanning lines constituting the scanning-line group differs between adjacent dots; and the thin-film transistor of one dot and the thin-film transistor of a dot adjacent thereto are scanned in different periods.

The foregoing objects are achieved in a sixth aspect of the present invention through the provision of a liquid-crystal display apparatus characterized in that liquid crystal is sandwiched between a pair of substrates oppositely disposed, a plurality of signal lines and a plurality of scanning lines are provided on one of the pair of substrates, and a plurality of pixels each having a plurality of different basic colors is provided; each pixel has the same number of dots as the number of the basic colors, enclosed by signal lines and scanning lines, and each dot has a thin-film transistor driven by one of the signal lines and one of the scanning lines, and a dot electrode electrically connected to the thin-film transistor; each scanning line has a each scanning line has section that runs parallel to the signal lines; and the thin-film transistor of one dot and the thin-film transistor of a dot adjacent thereto are scanned in different periods.

The foregoing objects are achieved in a seventh aspect of the present invention through the provision of a liquid-crystal display apparatus characterized in that liquid crystal is sandwiched between a pair of substrates oppositely disposed, a plurality of signal lines and a plurality of scanning lines are provided on one of the pair of substrates, the plurality of scanning lines is divided into a plurality of scanning-line groups each formed of a plurality of scanning lines, and a plurality of pixels each having a plurality of different basic colors is provided; each pixel has the same number of dots as the number of the basic colors, enclosed by adjacent signal lines and adjacent scanning lines, and each dot has a thin-film transistor driven by one of the signal lines and one of a plurality of scanning lines constituting a scanning-line group, and a dot electrode electrically connected to the thin-film transistor; among the plurality of scanning lines constituting a scanning-line group, the thin-film transistor of one dot and the thin-film transistor of a dot adjacent thereto are connected to different scanning lines, and each scanning line constituting a scanning-line group is electrically connected to the corresponding scanning lines in the plurality of scanning-line groups; and the thin-film transistor of one dot and the thin-film transistor of a dot adjacent thereto are scanned in different periods.

The liquid-crystal display apparatuses according to the fourth to seventh aspects of the present invention are so called multiple-fold scanning-line method liquid-crystal display apparatuses, in which a plurality of signal lines and a plurality of scanning lines are provided on one of a pair of substrates, and each pixel has the same number of dots as the number of basic colors, the dots being enclosed by adjacent signal lines and adjacent scanning lines (or scanning-line groups). A feature common to the liquid-crystal display apparatuses according to the first to fourth aspects of the present invention is a structure in which the thin-film transistor (TFT) of a dot constituting a pixel and the TFT of a dot adjacent thereto are scanned in different periods, although their specific structures differ. In the above description, "a dot adjacent thereto" means that a dot adjacent thereto in any direction, to the right, left, up, or down.

In conventional general active-matrix liquid-crystal display apparatuses, when the common inversion driving method is employed, horizontal line inversion is required. According to a structure of the present invention, since the TFTs of adjacent dots are scanning in different periods, even if common inversion driving is used, adjacent dots are made to have polarities reverse to each other, and the same result as that obtained by dot inversion driving is obtained. Therefore, the time frequency of flicker is made larger than in conventional cases because dot inversion is virtually implemented while the multiple-fold scanning-line method and common inversion driving are employed to save power consumption, and line crawling (flicker) is made difficult to visually recognize. In addition, a black straight line is displayed without ridges and steps at high quality because the colors R, G, and B are arranged in a horizontal stripe manner.

Differences among the liquid-crystal display apparatuses according to the fourth to seventh aspects of the present invention will be described below.

In the liquid-crystal display apparatuses according to the fourth and fifth aspects, selection circuits or TFTs used for scanning the TFTs of adjacent dots in different periods are added in each dot to a general structure of an active-matrix substrate.

The liquid-crystal display apparatus according to the fourth aspect uses selection circuits. The selection circuits are mounted in a pixel layout area, so that the number of scanning lines within the one substrate (TFT array substrate) does not need to be increased greatly. On the other hand, the liquid-crystal display apparatus according to the fifth aspect uses TFTs connected in series. With this structure, complicated selection circuits do not need to be added, and the TFTs are just added. Since the off resistance of the TFTs is higher than that of a TFT, the voltage applied to a dot electrode is maintained more stably.

The liquid-crystal display apparatuses according to the sixth and seventh aspects have a structure in which wiring of scanning lines is modified or the number of scanning lines is increased to drive the TFTs of adjacent dots by different scanning lines to scan the TFTs of the adjacent dots in different periods. With these structures, the TFTs of adjacent dots are scanned in different periods without adding active devices, which may cause a shift in a threshold voltage and a reduction in reliability.

The liquid-crystal display apparatus according to the sixth aspect is implemented by the minimum number of scanning lines and the minimum number of devices. In the apparatus, each scanning line weaves through pixel electrodes so as to have portions that run parallel to the signal lines. The liquid-crystal display apparatus according to the fourth aspect has an increased number of scanning lines, and has a smaller number of the intersections of wires as the liquid-crystal display apparatus according to the third aspect. Therefore, the occurrence probability of defects caused by short-circuits at wire intersections is reduced.

It is preferred in the structure of the liquid-crystal display apparatus according to the fourth aspect that each scanning-line group be formed of two scanning lines, and each selection circuit have two inputs and one output.

With this structure, the advantages of the liquid-crystal display apparatus according to the fourth aspect are obtained by the minimum number of scanning lines and the minimum number of selection circuits.

It is preferred in the structure of the liquid-crystal display apparatus according to the fifth aspect that each scanning-line group be formed of three scanning lines, and two TFTs connected in series are used.

With this structure, the advantages of the liquid-crystal display apparatus according to the fifth aspect are obtained by the minimum number of scanning lines and the minimum number of TFTs.

It is preferred in the structure of the liquid-crystal display apparatus according to the seventh aspect that each scanning-line group be formed of three scanning lines, and the corresponding scanning lines of the three scanning-line groups are electrically connected.

With this structure, in addition to the advantages of the liquid-crystal display apparatus according to the seventh aspect, an advantage is obtained in which R, G, and B image signals can be collectively handled. Therefore, the image signals can be easily handled.

As described above in detail, according to a structure of the present invention, a liquid-crystal display apparatus having a good image quality is obtained by making a good use of a plural-fold scanning line method and by sufficiently reducing line crawling, and power saving is also achieved at the same time. Further, the dispersion of the capacitances of parasitic capacitors formed by second electrodes and switching devices is suppressed, and hence, the dispersion of offset voltages is suppressed. Therefore, display problems such as flicker and burning are alleviated while design flexibility is maintained.

In addition, a black straight line is displayed without ridges and steps at high quality.

BRIEF DESCRIPTION OF THE DRAWINGS

FIG. 20B is a view showing a truth table of selection circuits provided for the TFT array substrate.

FIG. 23B is a view showing a table which indicates the input-and-output relationship of TFTs provided for the TFT array substrate.

DESCRIPTION OF THE PREFERRED EMBODIMENTS

First Embodiment

A liquid-crystal display apparatus according to a first embodiment of the present invention will be described below by referring to FIG. 1 to FIG. 4.

The liquid-crystal display apparatus of the present embodiment is an active-matrix liquid-crystal display apparatus in which liquid crystal is sandwiched by an active-matrix-substrate and an opposing substrate disposed oppositely. On the active-matrix substrate, a plurality of signal lines and a plurality of scanning lines are provided in a checker-pattern manner, and a great number of color pixels each having three basic colors, R, G, and B are provided in a matrix manner.

It can be appreciated to those skilled in the art that "basic colors" can include any basic color models suitable for displaying colors on a liquid-crystal display. That is, the current invention is not limited to the use of primary colors (red (R), green (g) and blue (b)) and other basic color models such as CYMK or other color models may be employed.

Figure 1:
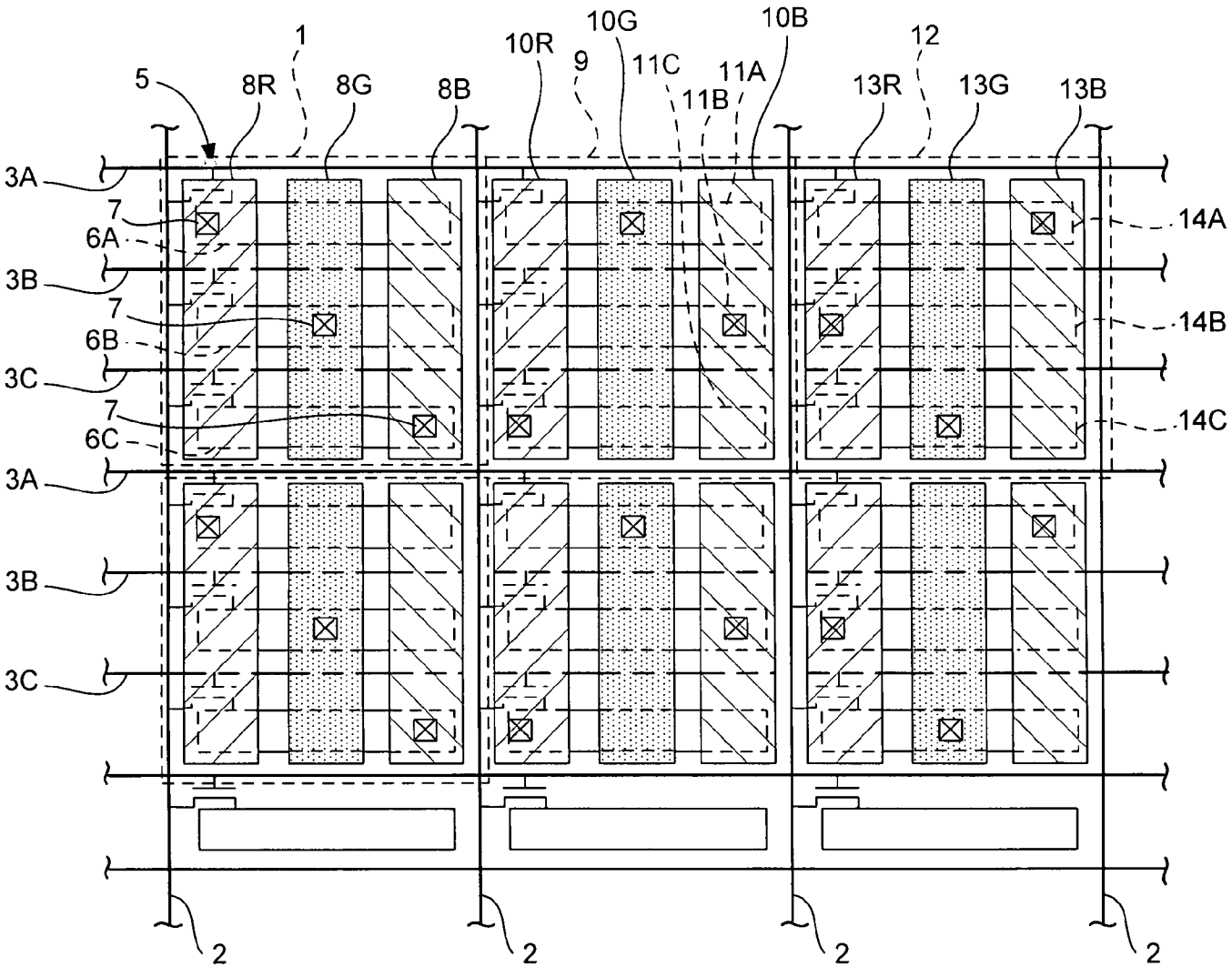
FIG. 1 is a plan showing, in an overlapping manner, dot electrodes and display electrodes disposed thereabove in an active-matrix substrate of a liquid-crystal display apparatus according to a first embodiment of the present invention.
Figure 2:
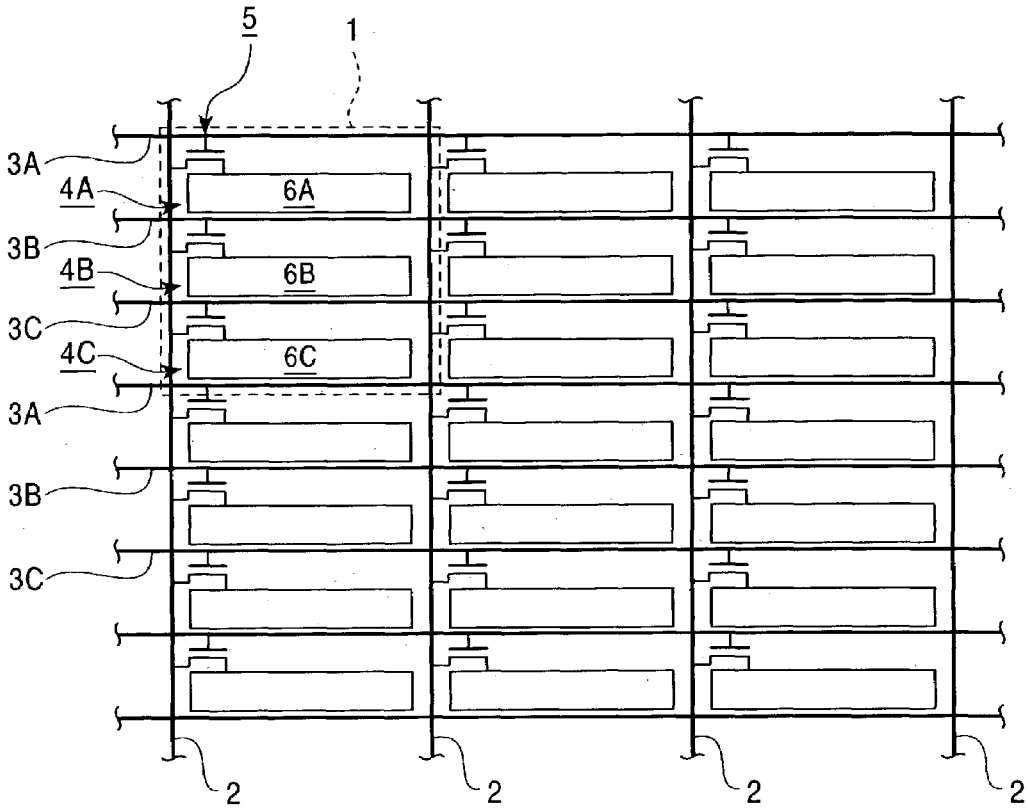
FIG. 2 is a plan showing only the dot electrodes in the active-matrix substrate of the liquid-crystal display apparatus according to the first embodiment of the present invention.

FIG. 1 and FIG. 2 show an outlined structure of only two rows by three columns of the great number of color pixels provided for the active-matrix substrate. In the present embodiment, electrodes are formed in a two-story structure. FIG. 2 is a plan showing only dot electrodes, described later, placed at a lower story, and FIG. 1 is a plan showing display electrodes placed above the dot electrodes together with the dot electrodes. One color pixel 1 constituting the active-matrix substrate is formed of three dots 4A, 4B, and 4C enclosed by signal lines 2 adjacent to each other and scanning lines 3A, 3B, and 3C adjacent to each other, as shown in FIG. 2. In the dots 4A, 4B, and 4C, switching devices 5 such as TFTs electrically connected to the scanning lines 3A, 3B, and 3*c* and a signal line 2 are provided in a vicinity of the intersections of the scanning lines 3A, 3B, and 3C and the signal line 2, and landscape-rectangular dot electrodes (first electrodes) 6A, 6B, and 6C electrically connected to the switching devices 5 are also provided.

Further, an insulation layer (not shown) which covers the dot electrodes 6A, 6B, and 6C is provided. As shown in FIG. 1, three portrait-rectangular display electrodes (second electrodes) 8R, 8G, and 8B electrically connected to the dot electrodes 6A, 6B, and 6C through contact holes 7 passing through the insulation layer are provided on the insulation layer. The display electrodes 8R, 8G, and 8B are extended in a direction intersecting with the dot electrodes 6A, 6B, and 6C and are disposed over the three dot electrodes 6A, 6B, and 6C. The display electrodes 8R, 8G, and 8B are electrically connected to the dot electrodes 6A, 6B, and 6C through the contact holes 7 such that each display electrode is electrically connected to only one of the three dot electrodes, and each dot electrode is electrically connected to only one display electrode.

The R, G, and B colored layers (not shown) of a color filter are provided corresponding to the display electrodes 8R, 8G, and 8B. For example, the display electrode 8R, disposed at the left-hand side of each color pixel 1 corresponds to red (R), the display electrode 8G, disposed at the center, corresponds to green (G), and the display electrode 8B, disposed at the right-hand side, corresponds to blue (B). The colored layers are arranged periodically through a plurality of color pixels 1, and the arrangement in the entire color filter forms a so-called vertical stripe.

The arrangement of the contact holes 7 differ between color pixels 1. In other words, the connections between the dot electrodes and the display electrodes differ between color pixels 1. For example, referring to the upper left-hand-side pixel 1 of FIG. 1, in the present embodiment, the upper dot electrode 6A is connected to the left-hand-side display electrode 8R, the center dot electrode 6B is connected to the center display electrode 8G, and the lower dot electrode 6C is connected to the right-hand-side display electrode 8B. Contrarily, referring to the pixel 9 to the right of pixel 1, the upper dot electrode 11A is connected to the center display electrode 10G, the center dot electrode 11B is connected to the right-hand-side display electrode 10B, and the lower dot electrode 11C is connected to the left-hand-side display electrode 10R. Further, referring to the pixel 12 to the right of pixel 9, the upper dot electrode 14A is connected to the right-hand-side display electrode 13B, the center dot electrode 14B is connected to the left-hand-side display electrode 13R, and the lower dot electrode 14C is connected to the center display electrode 13G.

Contact holes 7 in color pixels 1 (not shown) further disposed horizontally in the first row are arranged repeatedly by the pattern used in the above three color pixels. The arrangement of contact holes in each color pixel in a second row is the same as that in the first row. In other words, the same pattern is repeated when color pixels are viewed vertically.

It is understood from the above that the positions of the contact holes 7 determine the display electrodes 8R, 8G, and 8B into which image signals are written at the same time by the same scanning lines 3A, 3B, and 3C, and the colors R, G, and B corresponding to the display electrodes 8R, 8G, and 8B. For Example, in the case shown in FIG. 1, during a scan, scanning line 3A writes image signals to display electrodes 8R, 8G and 8B. The rate in which each of the display electrodes 8R, 8G and 8B (each with a corresponding basic color) emits light is substantially the same to each other.

Figure 3:
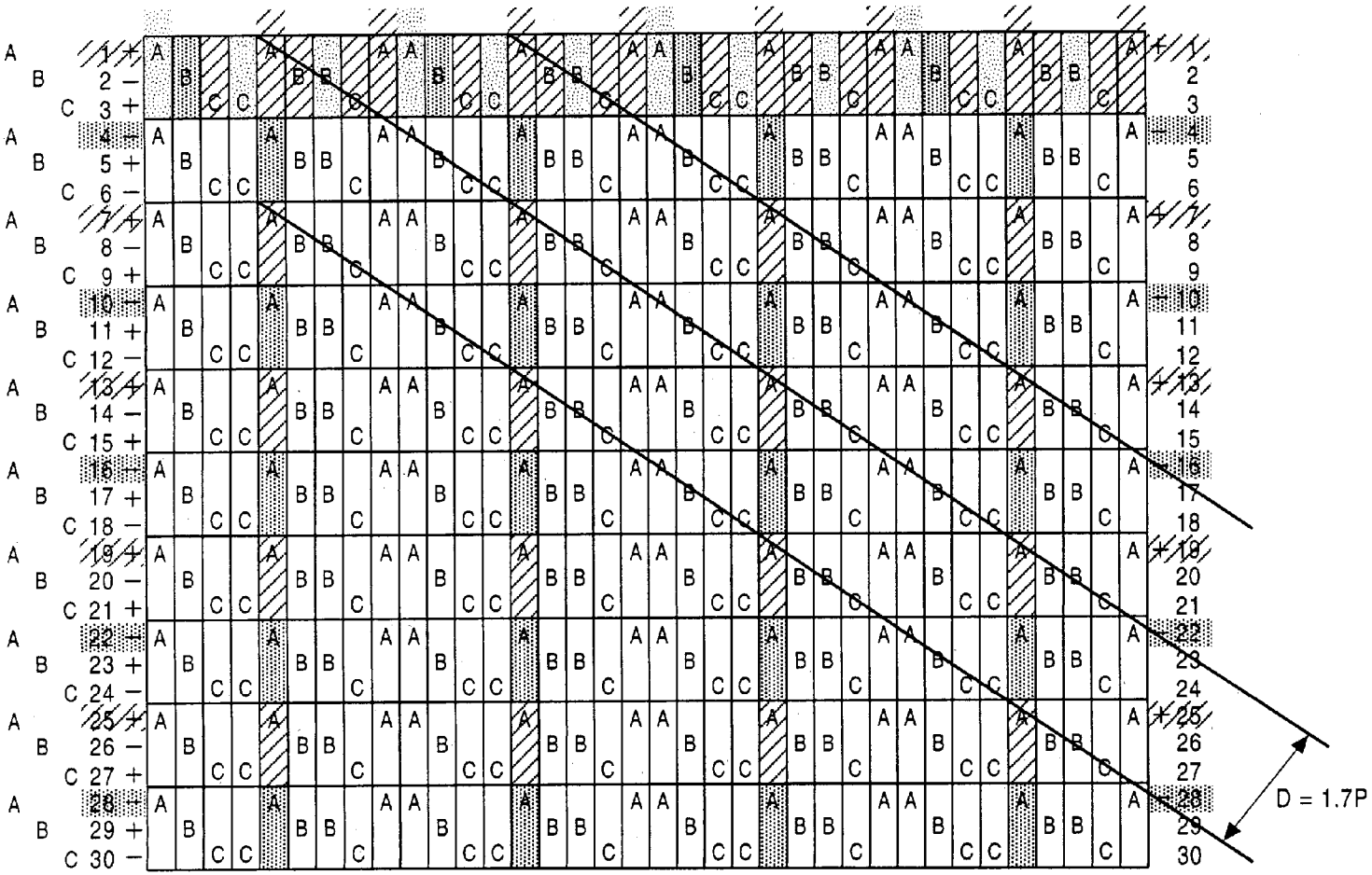
FIG. 3 is a view showing, in a sketch manner, timing at which image signals are written into display electrodes, and the polarities of the image signals written into the display electrodes (at 3:1 interlaced scanning), with the arrangement of contact holes shown in FIG. 1.

FIG. 3 shows, in an outlined manner, timing at which image signals are written into display electrodes 8R, 8G, and 8B, and the polarities of the image signals written into the display electrodes 8R, 8G, and 8B when a unit formed of the three pixels shown in FIG. 1 is repeatedly arranged as is in the liquid-crystal display apparatus according to the present embodiment, having the above structure. When 3:1 interlaced common-inversion driving is performed with the above arrangement of the contact holes 7, the interval D of a plurality of lines obtained by connecting dots having the same basic color and being driven by the same-polarity driving voltage in their vicinities is 1.7P, where P indicates the pitch of color pixels each formed of three dots. In FIG. 3, lines are drawn for positive-polarity G dots written at timing A.

Figure 28:
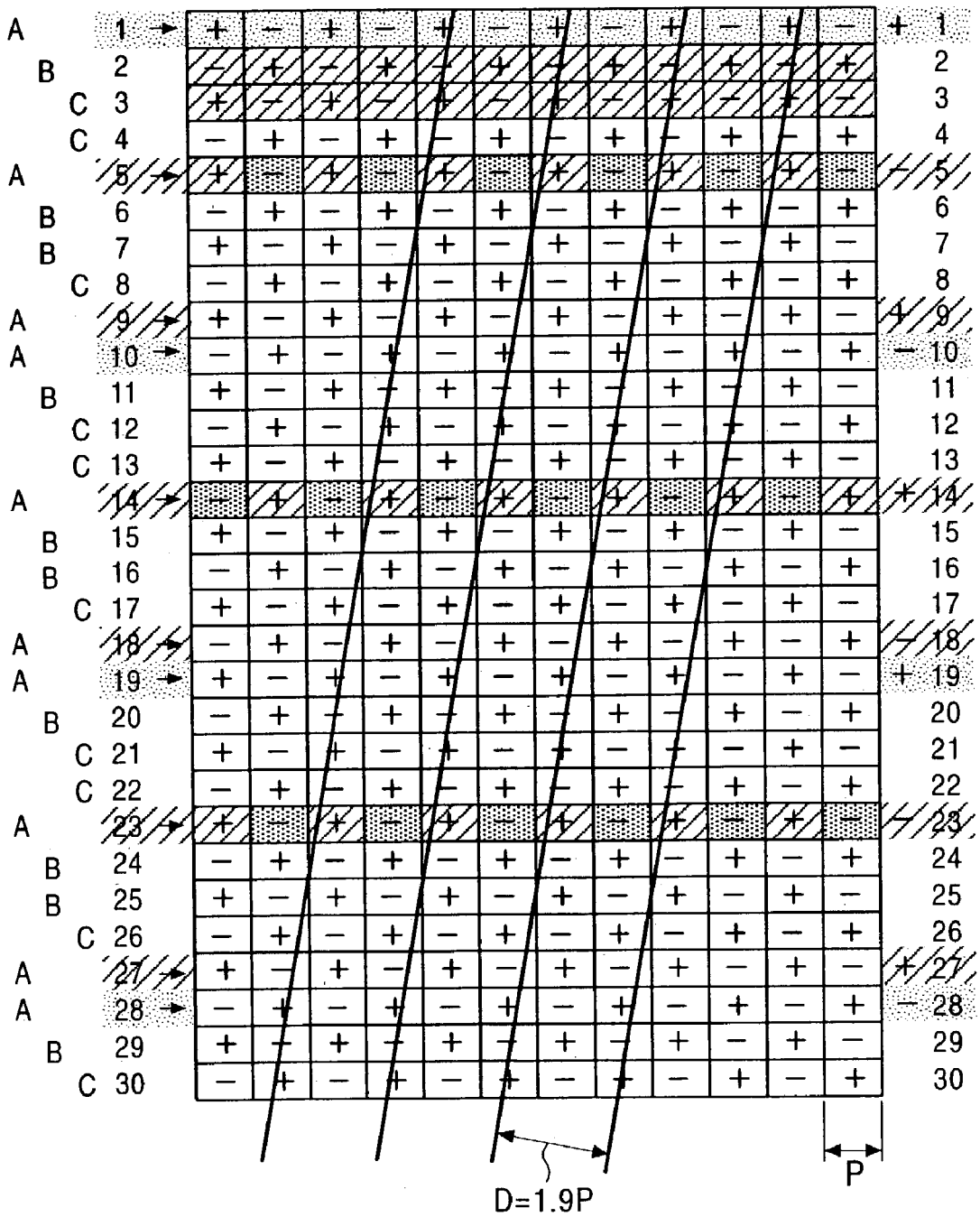
FIG. 28 PRIOR ART
FIG. 28 is a view showing, in a sketch manner, timing at which image signals are written into display electrodes, and the polarities of the image signals written into the display electrodes in a conventional 3:1 interlaced scanning and dot inversion driving method.
Figure 29:
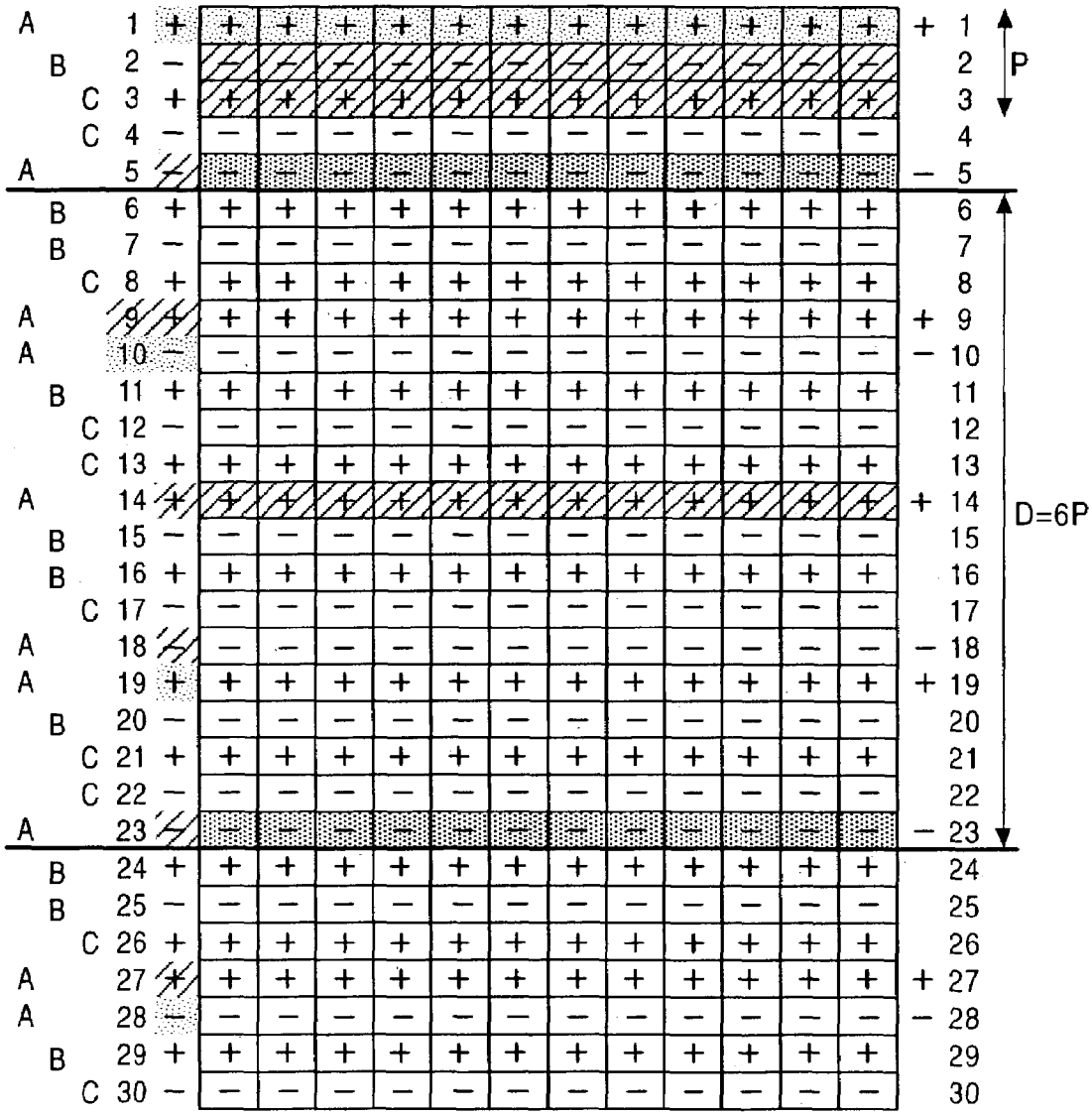
FIG. 29 PRIOR ART
FIG. 29 is a view showing, in a sketch manner, timing at which image signals are written into display electrodes, and the polarities of the image signals written into the display electrodes in a conventional 3:1 interlaced scanning and common inversion driving method.

In the present embodiment, as described above, the interval D is much smaller than 6P (see FIG. 29) obtained in conventional common inversion driving, and even smaller than 1.9P (see FIG. 28) obtained in dot inversion driving. Line crawling is more difficult to visually recognize. In the present embodiment, when P is 127 μm (200 ppi), D is 216 μm, which is smaller than 260 μm and desired. Conversely, to set D to 260 μm, P just needs to be 153 μm, which is sufficiently practical. With the use of common inversion driving, the liquid-crystal display apparatus consumes less power.

Figure 4:
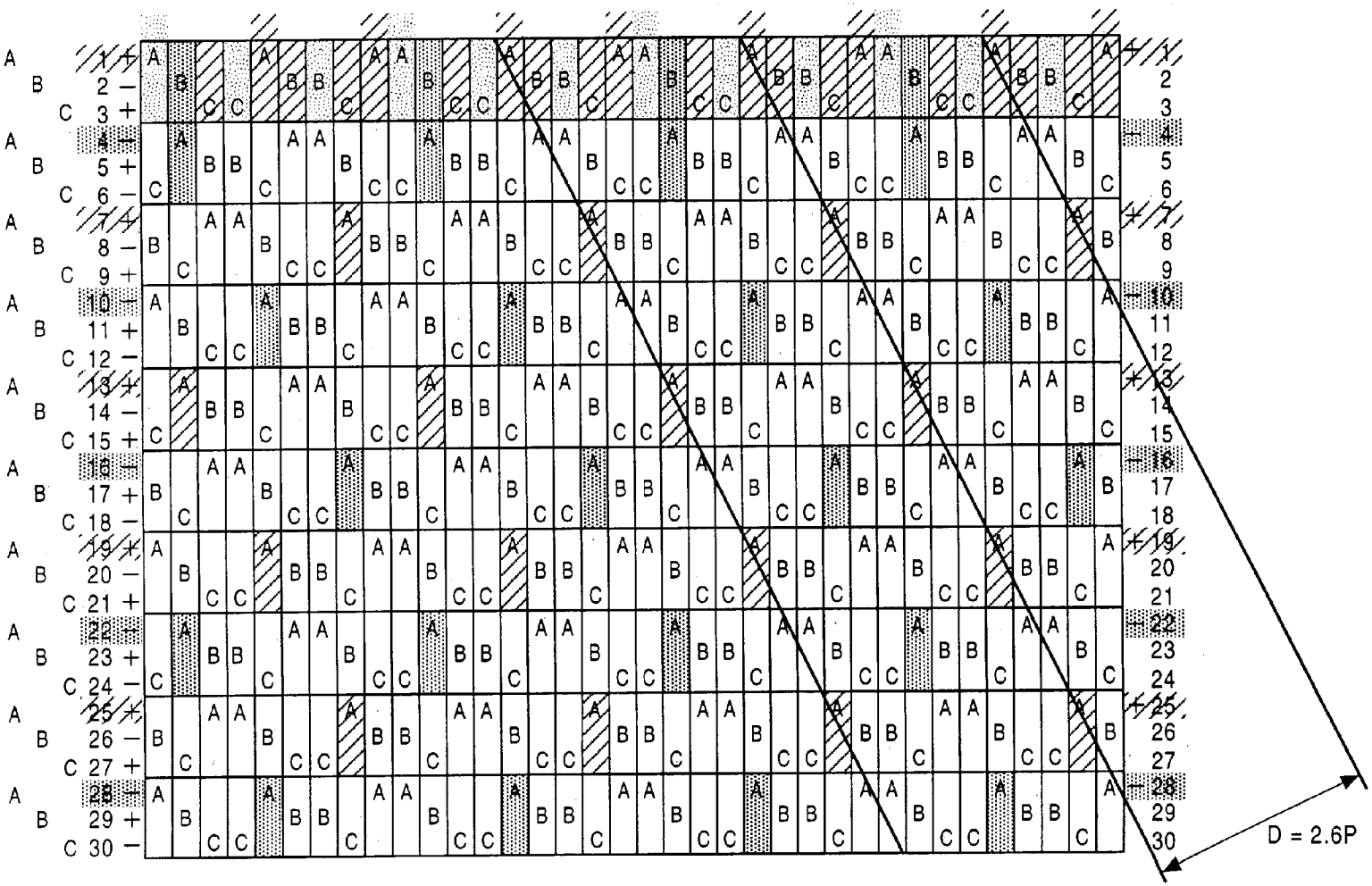
FIG. 4 is a view showing, in a sketch manner, timing at which image signals are written into display electrodes, and the polarities of the image signals written into the display electrodes with the arrangement of contact holes, different from that shown in FIG. 3.
Figure 5:
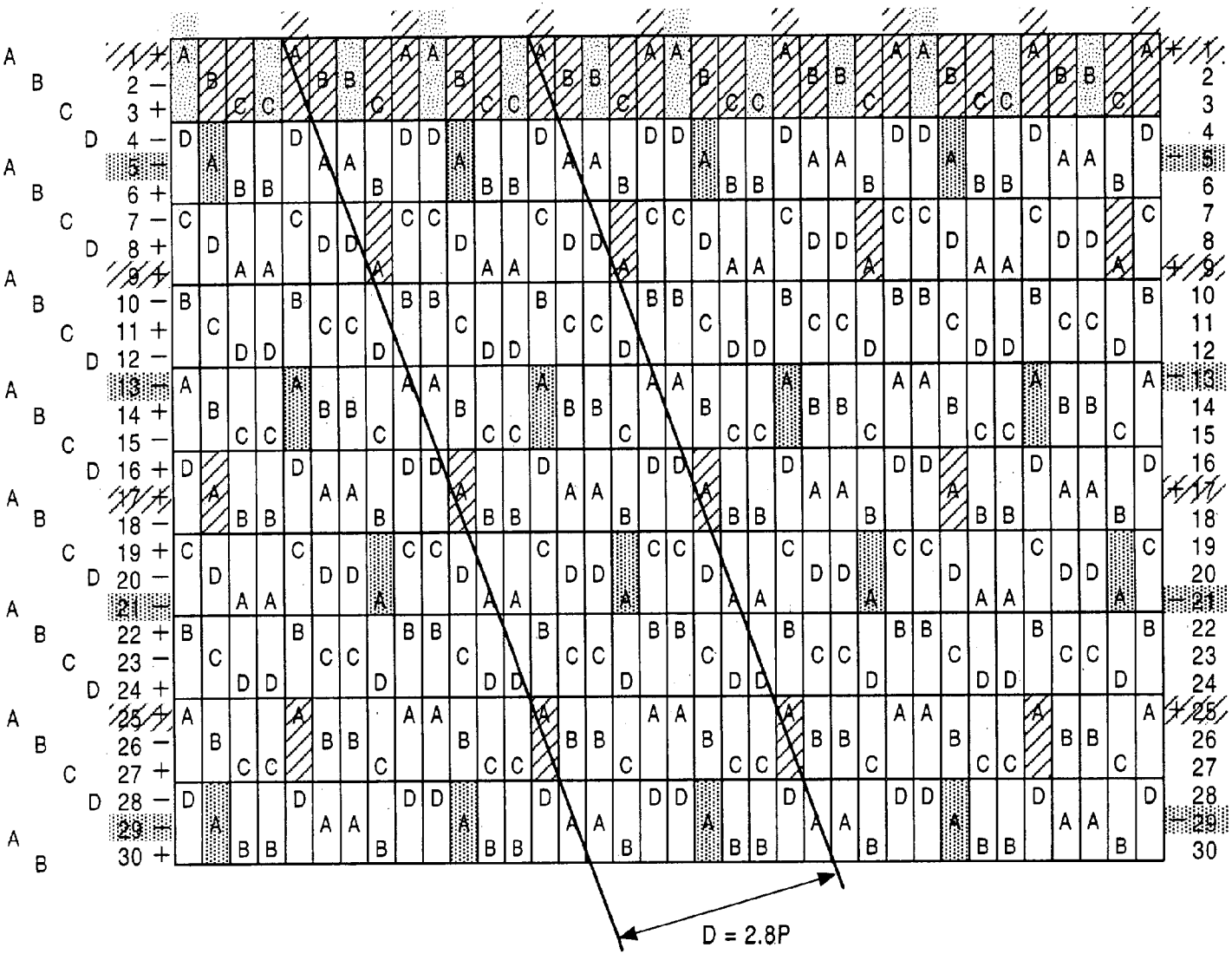
FIG. 5 is a view showing, in a sketch manner, timing at which image signals are written into display electrodes, and the polarities of the image signals written into the display electrodes (at 4:1 interlaced scanning), with the arrangement of contact holes in a liquid-crystal display apparatus according to a second embodiment of the present invention.
Figure 6:
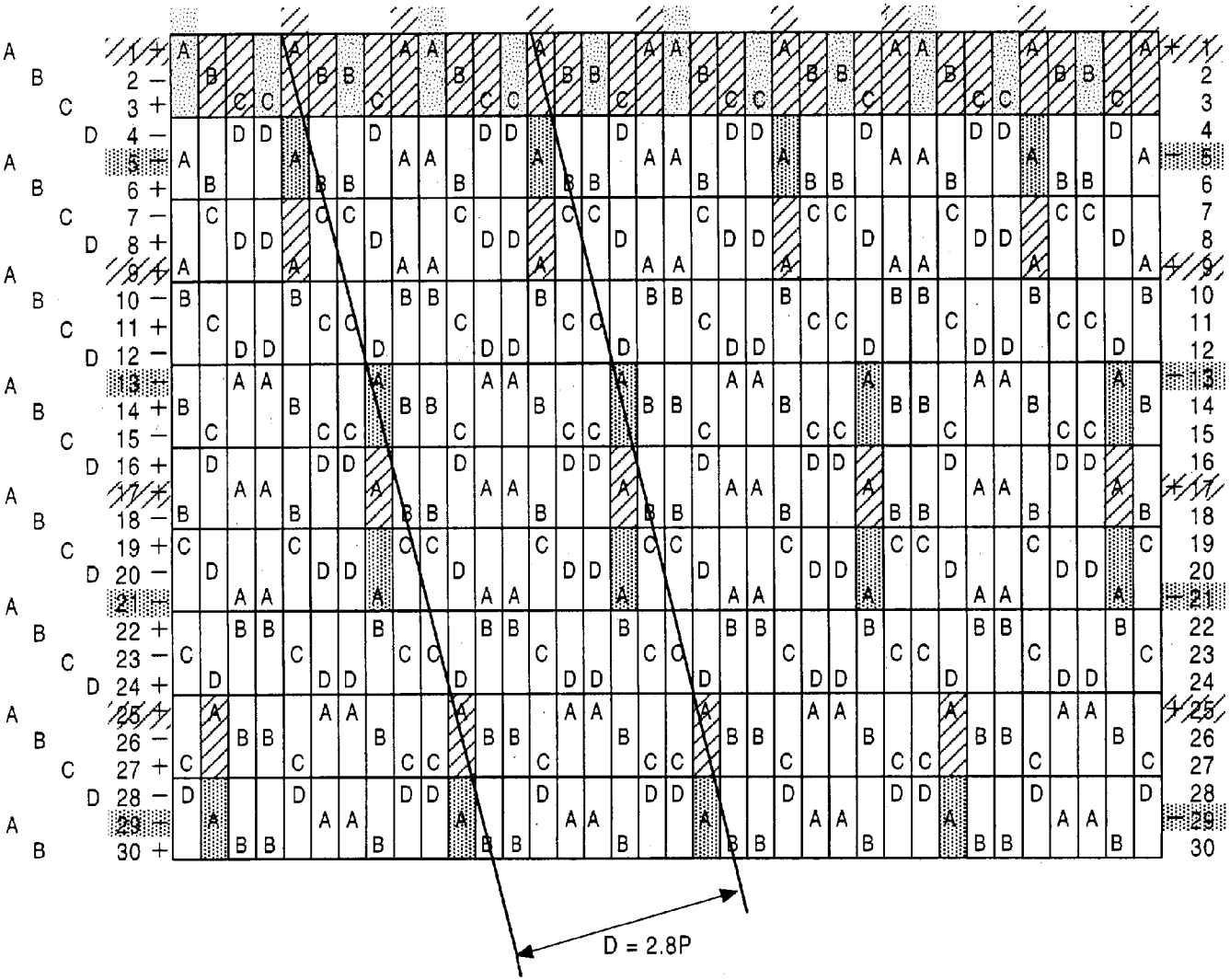
FIG. 6 is a view showing, in a sketch manner, timing at which image signals are written into display electrodes, and the polarities of the image signals written into the display electrodes with the arrangement of contact holes, different from that shown in FIG. 5.
Figure 7:
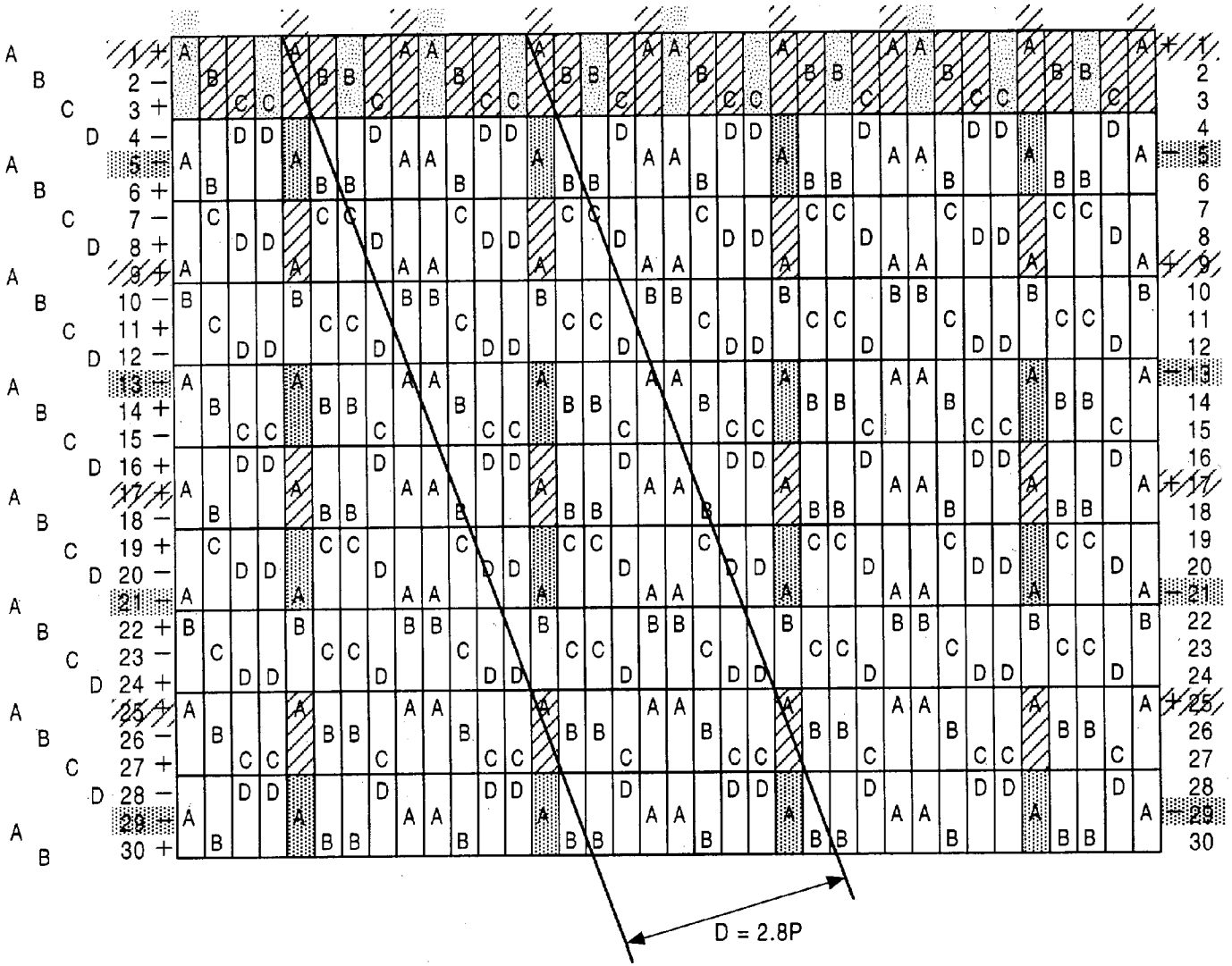
FIG. 7 is a view showing, in a sketch manner, timing at which image signals are written into display electrodes, and the polarities of the image signals written into the display electrodes with the arrangement of contact holes, still different from that shown in FIG. 5.
Figure 8:
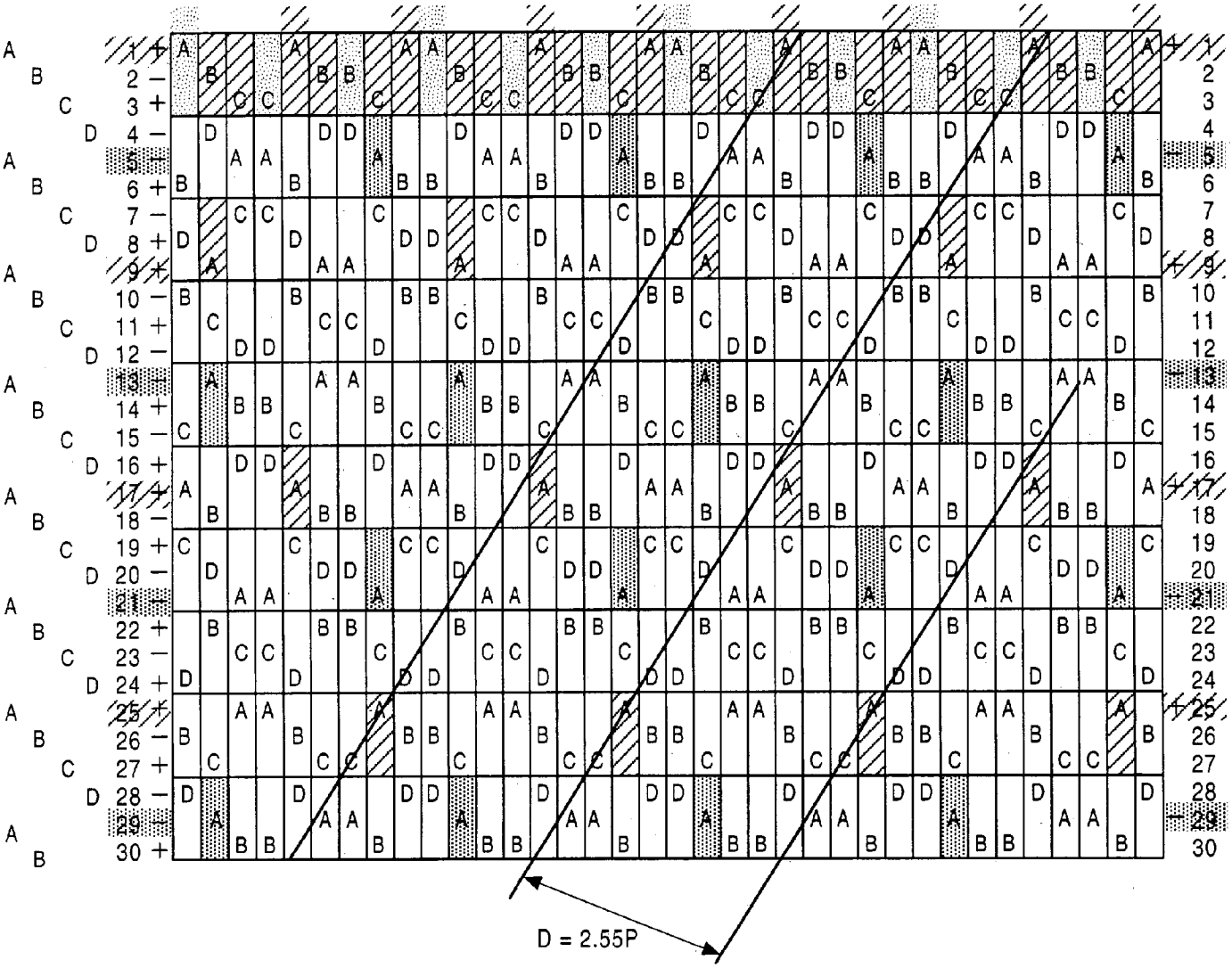
FIG. 8 is a view showing, in a sketch manner, timing at which image signals are written into display electrodes, and the polarities of the image signals written into the display electrodes with the arrangement of contact holes, yet different from that shown in FIG. 5.

FIG. 4 shows a case in which the arrangement of the contact holes 7 shown in FIG. 3 is slightly changed, and more specifically, shows a case in which the unit shown in FIG. 1 is shifted horizontally by one color pixel in adjacent rows. In this case, D is 2.6P, which is worse than in conventional dot inversion driving. When P is 127 μm (200 ppi), D is 330 μm, which is tolerable. A substantial improvement is obtained, compared with conventional common inversion driving.

Second Embodiment

A liquid-crystal display apparatus according to a second embodiment of the present invention will be described below by referring to FIG. 5 to FIG. 8.

In the first embodiment, 3:1 interlaced common-inversion driving is used. In the present embodiment, 4:1 interlaced common-inversion driving is performed. Since the basic structure of the liquid-crystal display apparatus is the same as in the first embodiment, a description thereof is omitted.

FIG. 5 to FIG. 8 show, in an outlined manner, timing at which image signals are written into display electrodes 8R, 8G, and 8B, and the polarities of the image signals written into the display electrodes 8R, 8G, and 8B in an example arrangement of contact holes having four types. Since 4:1 interlaced driving is performed in the present embodiment, four types of timing are indicated by letters A, B, C, and D. In FIG. 5 to FIG. 8, lines are drawn for positive-polarity G dots written at timing A. In the arrangements shown in FIG. 5 to FIG. 7, D is 2.8P. Contrarily, in the arrangement of FIG. 8, D is 2.55P, which is the smallest among the four types of arrangements. In this case, when P is 127 μm (200 ppi), D is 323 μm, which is tolerable. A substantial improvement is obtained, compared with the conventional common inversion driving.

Third Embodiment

A liquid-crystal display apparatus according to a third embodiment of the present invention will be described below by referring to FIG. 9.

In the present embodiment, 5:1 interlaced common-inversion driving is performed. Since the basic structure of the liquid-crystal display apparatus is the same as in the first embodiment, a description thereof is omitted.

Figure 9:
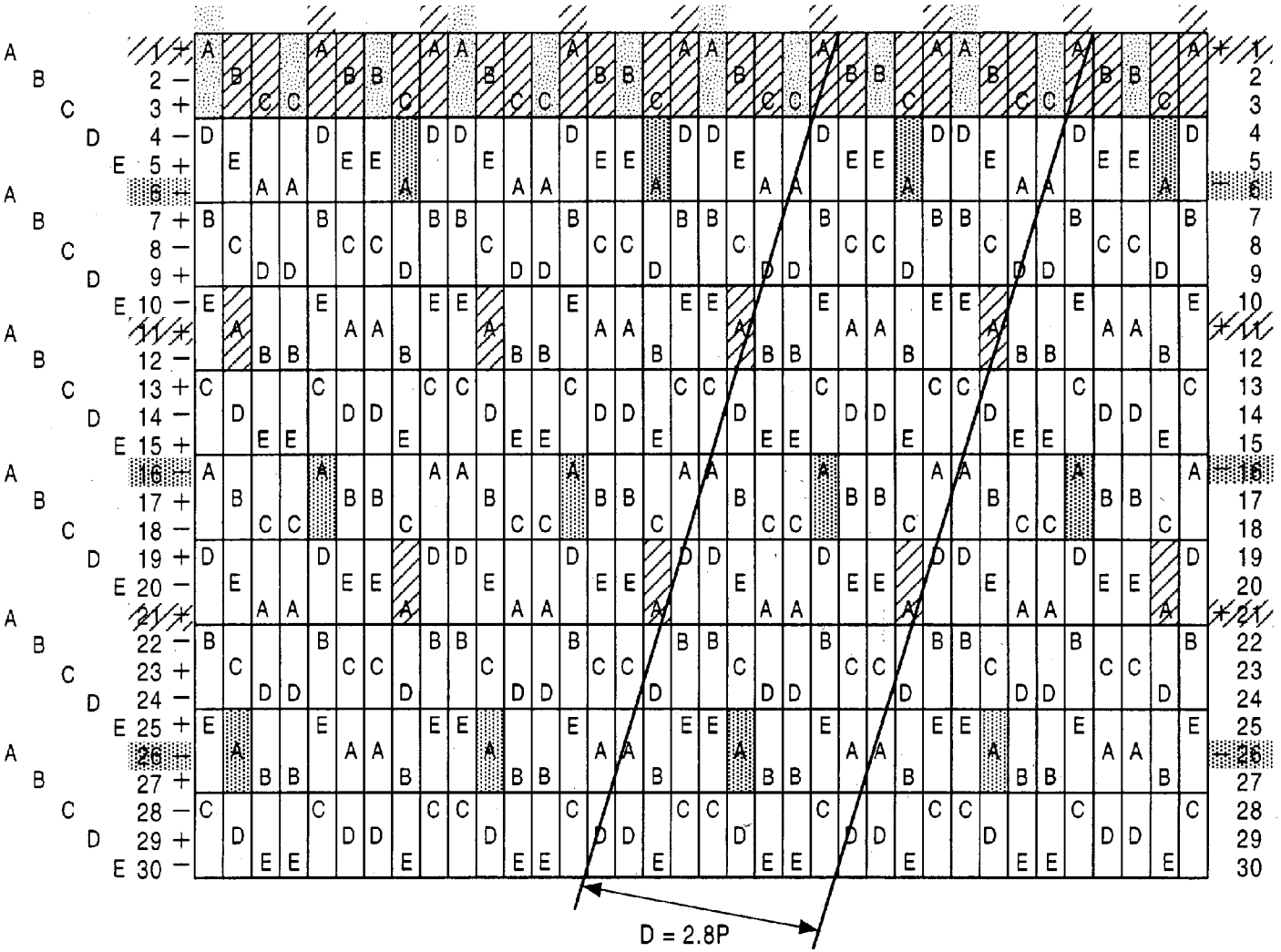
FIG. 9 is a view showing, in a sketch manner, timing at which image signals are written into display electrodes, and the polarities of the image signals written into the display electrodes (at 5:1 interlaced scanning), with the arrangement of contact holes in a liquid-crystal display apparatus according to a third embodiment of the present invention.

FIG. 9 shows, in an outlined manner, timing at which image signals are written into display electrodes 8R, 8G, and 8B, and the polarities of the image signals written into the display electrodes 8R, 8G, and 8B. Since 5:1 interlaced driving is performed in the present embodiment, five types of timing are indicated by letters A, B, C, D, and E. In FIG. 9, lines are drawn for positive-polarity G dots written at timing A. In the present embodiment, D is 2.8P. In this case, when P is 127 μm (200 ppi), D is 355 μm, which is tolerable but larger than in 3:1 and 4:1 interlaced driving. A substantial improvement is obtained, however, compared with the conventional common inversion driving.

Fourth Embodiment

A liquid-crystal display apparatus according to a fourth embodiment of the present invention will be described below by referring to FIG. 10.

In the present embodiment, 6:1 interlaced common-inversion driving is performed. Since the basic structure of the liquid-crystal display apparatus is the same as in the first embodiment, a description thereof is omitted.

Figure 10:
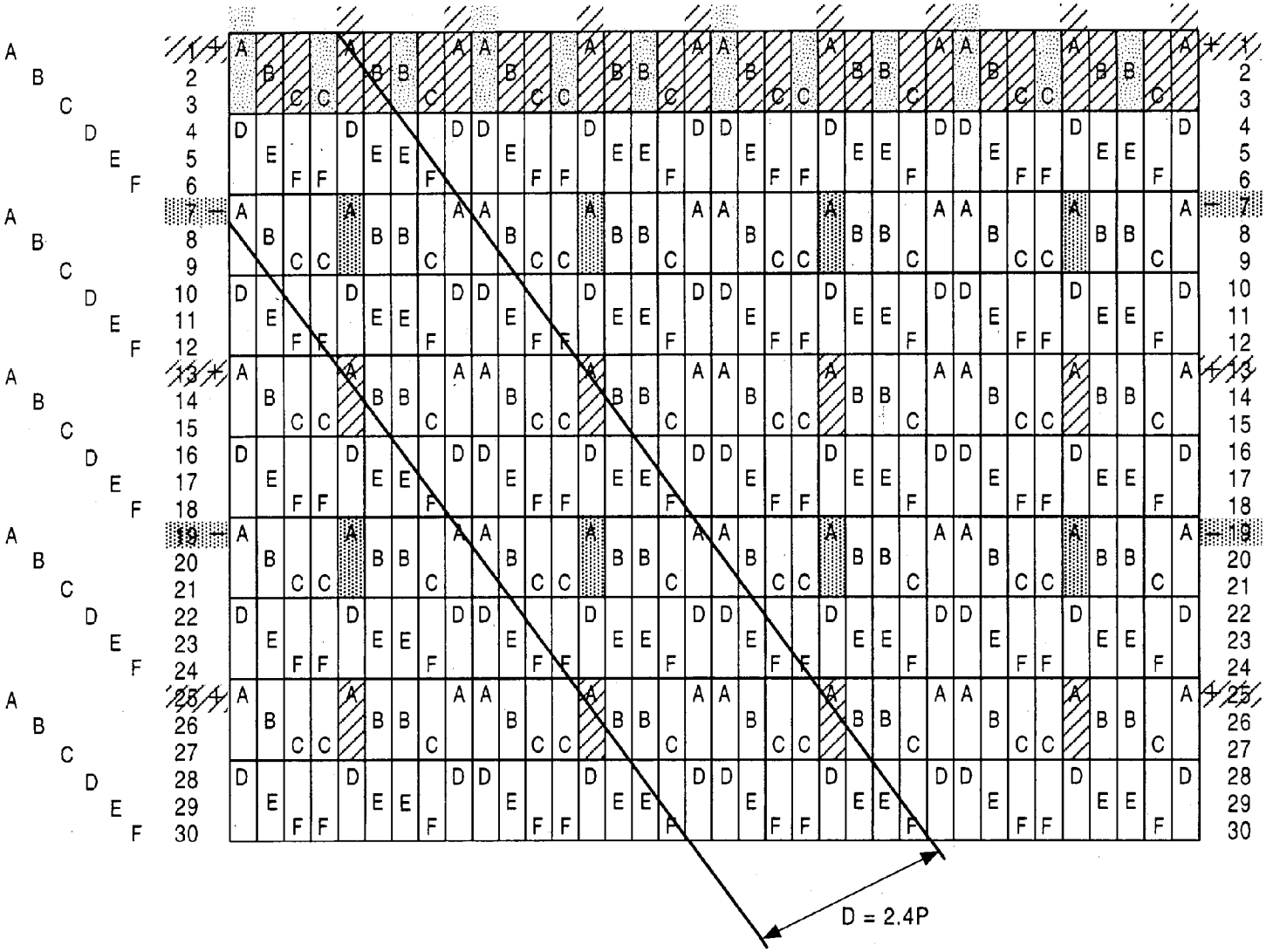
FIG. 10 is a view showing, in a sketch manner, timing at which image signals are written into display electrodes, and the polarities of the image signals written into the display electrodes (at 6:1 interlaced scanning), with the arrangement of contact holes in a liquid-crystal display apparatus according to a fourth embodiment of the present invention.

FIG. 10 shows, in an outlined manner, timing at which image signals are written into display electrodes 8R, 8G, and 8B, and the polarities of the image signals written into the display electrodes 8R, 8G, and 8B. Since 6:1 interlaced driving is performed in the present embodiment, six types of timing are indicated by letters A, B, C, D, E, and F. In FIG. 10, lines are drawn for positive-polarity G dots written at timing A. In the present embodiment, D is 2.4P. In this case, when P is 127 μm (200 ppi), D is 305 μm, which is tolerable and more improvement is obtained than in 4:1 and 5:1 interlaced driving.

The minimum line intervals D in the first to fourth embodiments will be summarized below. The interval D is 1.7P (when P is 90 μm, D is 153 μm) in 3:1 interlaced driving, the interval D is 2.55P (when P is 90 μm, D is 230 μm) in 4:1 interlaced driving, the interval D is 2.8P (when P is 90 μm, D is 252 μm) in 5:1 interlaced driving, and the interval D is 2.4P (when P is 90 μm, D is 216 μm) in 6:1 interlaced driving. In all of the above cases, D is shorter than 260 μm at a color-pixel pitch P of 90 μm (280 ppi), which means that line crawling can be improved to a desirable level. Contrarily, even at such a minute color-pixel pitch, D=6P is 540 μm in common inversion driving at the conventional structure, which is not practical.

Fifth Embodiment

A liquid-crystal display apparatus according to a fifth embodiment of the present invention will be described below by referring to FIG. 11, FIG. 2, and FIG. 3.

Since the basic structure of the liquid-crystal display apparatus is the same as in the first embodiment, a description thereof is omitted.

In the present embodiment, switching devices 5 and display electrodes 8R, 8G, and 8B do not overlap with each other vertically in the process layer stack of the apparatus. Therefore, the switching devices 5 are covered by an insulation layer, but the display electrodes 8R, 8G, and 8B are not disposed above the switching devices 5.

In the liquid-crystal display apparatus shown in the first embodiment, the switching devices 5 and a part of the display electrodes overlap vertically in the process layer stack of the apparatus. Whereas switching devices 5 and all display electrodes 8R corresponding to R (red) overlap, switching device 5 and all display electrodes 8G and 8B corresponding to G (green) and B (blue) do not overlap. In such a structure, since parasitic capacitors generated by the display electrodes 8R, 8G, and 8B and the switching devices 5 do not have the same capacitance between those corresponding to the display electrodes 8R and those corresponding to the display electrodes 8G and 8B, the offset voltages vary, and display problems such as flicker and burning occur in some cases.

Figure 11:
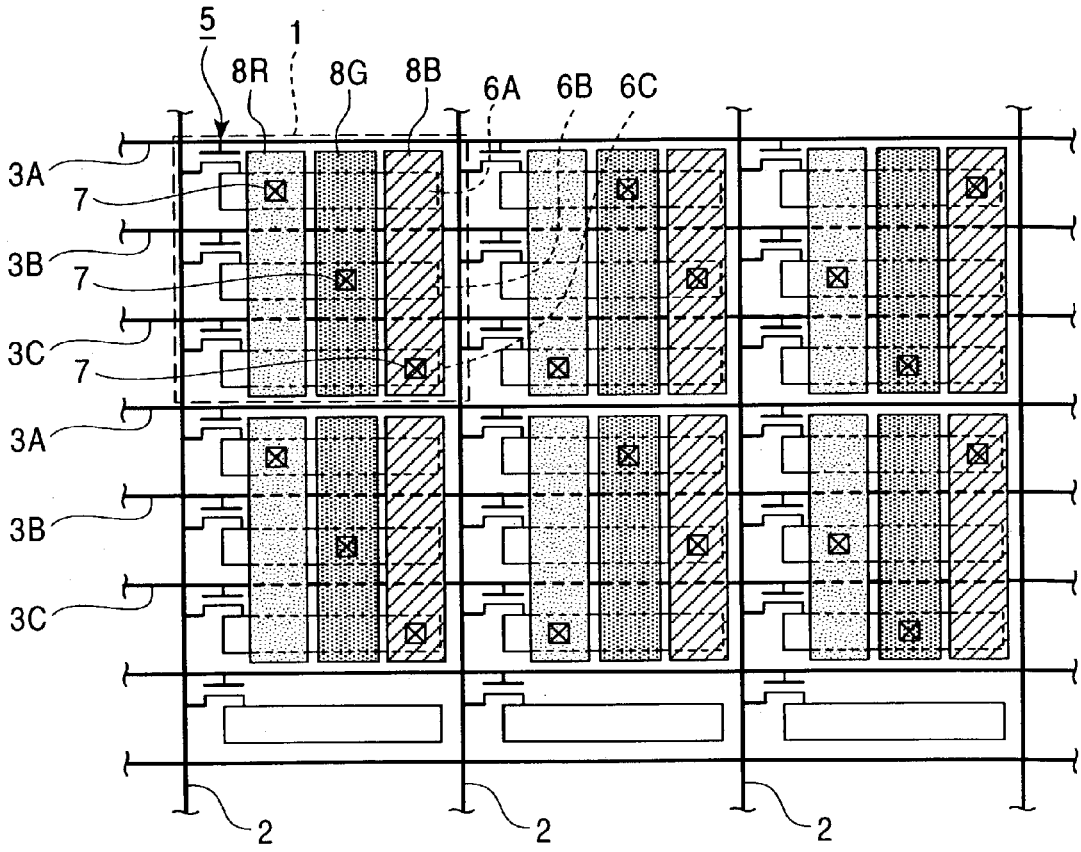
FIG. 11 is a plan showing, in an overlapping manner, dot electrodes and display electrodes disposed thereabove in an active-matrix substrate of a liquid-crystal display apparatus according to a fifth embodiment of the present invention.

Contrarily, in the liquid-crystal display apparatus according to the present embodiment, the switching devices 5 and the display electrodes 8R, 8G, and 8B do not overlap vertically in the process layer stack, as shown in FIG. 11. Therefore, the parasitic capacitors generated by the switching devices 5 and the display electrodes 8R, 8G, and 8B have sufficiently small capacitances, and the offset voltages vary a little among a plurality of display electrodes 8R, 8G, and 8B. As a result, display problems such as flicker and burning can be eliminated while design flexibility is maintained.

Sixth Embodiment

A liquid-crystal display apparatus according to a sixth embodiment of the present invention will be described below by referring to FIG. 12 and FIG. 13.

The basic structure of the liquid-crystal display apparatus according to the present embodiment is almost the same as in the fifth embodiment. FIG. 13 is a plan showing only dot electrodes 6A, 6B, and 6C of the liquid-crystal display apparatus, and FIG. 12 is a plan further showing display electrodes 8R, 8G and 8B placed above the dot electrodes 6A, 6B, and 6C together with the dot electrodes. In FIG. 12 and FIG. 13, the same symbols as those used in FIG. 11 and FIG. 2 are assigned to the same components as those shown in FIG. 11 and FIG. 2, and detailed descriptions thereof are omitted.

Figure 12:
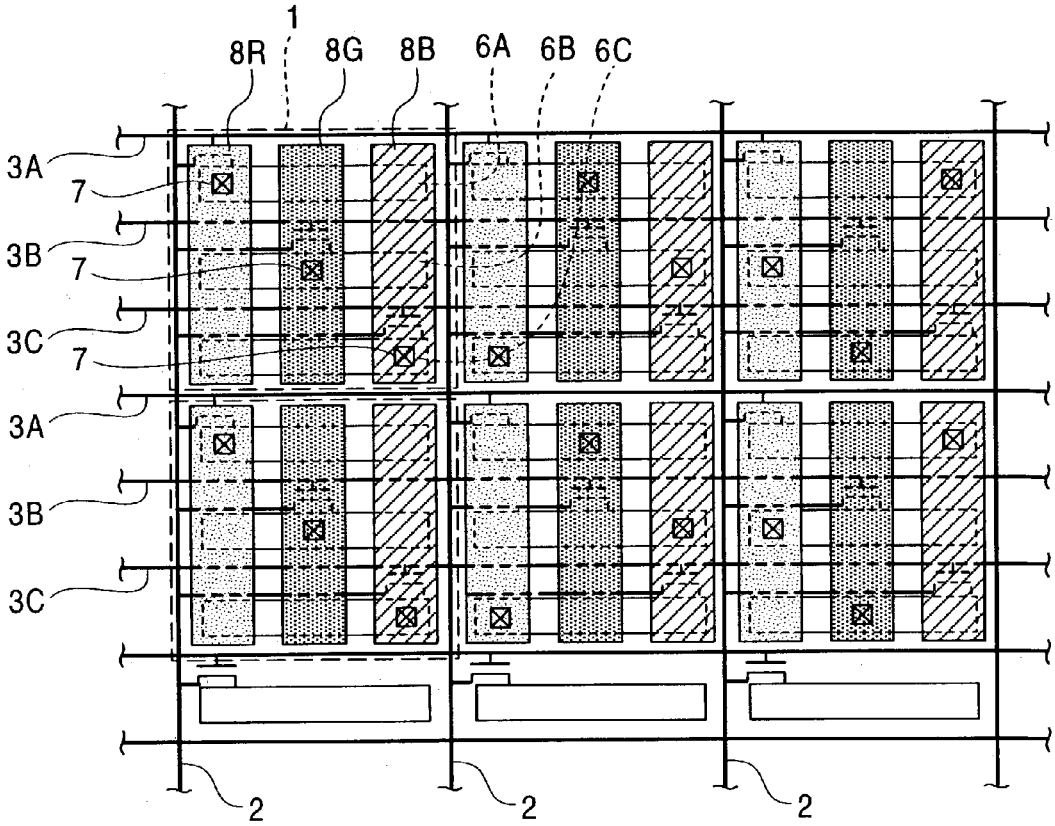
FIG. 12 is a plan showing, in an overlapping manner, dot electrodes and display electrodes disposed thereabove in an active-matrix substrate of a liquid-crystal display apparatus according to a sixth embodiment of the present invention.
Figure 13:
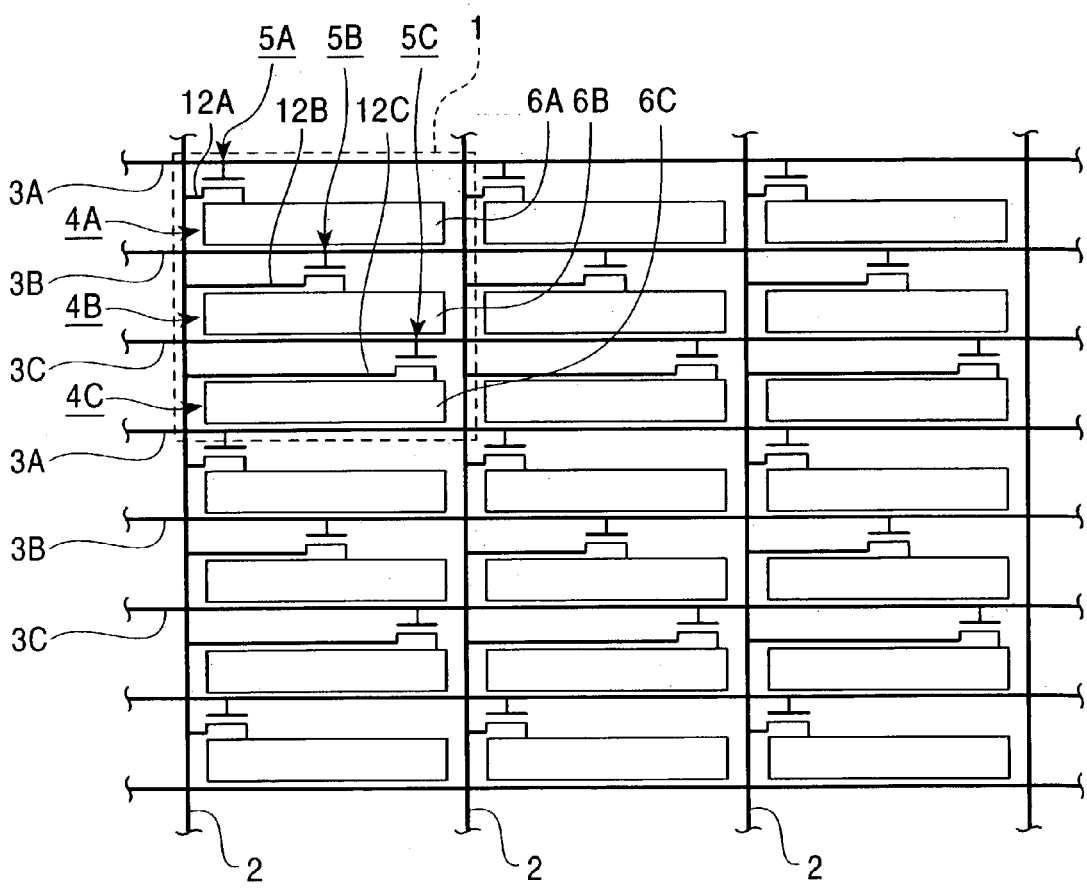
FIG. 13 is a plan showing only the dot electrodes in the active-matrix substrate of the liquid-crystal display apparatus according to the sixth embodiment of the present invention.

Whereas all the switching devices 5 and any display electrodes 8R, 8G, and 8B do not overlap with each other vertically in the process layer stack in the liquid-crystal display apparatus according to the fifth embodiment, three switching devices 5A, 5B, and 5C in one color pixel 1 and three display electrodes 8R, 8G, and 8B in the color pixel 1 overlap vertically in the process layer stack, respectively, in the liquid-crystal display apparatus according to the present embodiment, as shown in FIG. 12 and FIG. 13. In one color pixel 1, two switching devices do not overlap with the same display electrode. The three switching devices 5A, 5B, and 5C overlap with the different display electrodes 8R, 8G, and 8B, respectively. In other words, each of the display electrodes 8R, 8G, and 8B overlap with only one of the switching devices 5A, 5B, and 5C, and the numbers of the switching devices 5A, 5B, and 5C which overlap with the display electrodes 8R, 8G, and 8B are equal for all the display electrodes 8R, 8G, and 8B.

In a lower-layer structure, as shown in FIG. 13, the switching device 5A is disposed at the left-hand side of the dot 4A, which is placed at the upper position in one color pixel 1, the switching device 5B is disposed at the center of the dot 4B, which is placed at the center position in the color pixel 1, and the switching device 5C is disposed at the right-hand side of the dot 4A, which is placed at the lower position in the color pixel 1. A signal line 2 for sending an image signal to the dot electrodes 6A, 6B, and 6C is disposed at the left-hand side of the dots 4A, 4B, and 4C, and signal sub-lines 12A, 12B, and 12C branched from the signal line 2 are provided for the dots. The signal sub-lines 12A, 12B, and 12C are connected to the switching devices 5A, 5B, and 5C, respectively, and an image signal is sent to the switching devices 5A, 5B, and 5C through the signal sub-lines 12A, 12B, and 12C. In the present embodiment, one end of each of the signal sub-lines 12A, 12B, and 12C is connected to the signal line 2, and the other end is connected to the source of a TFT which constitutes each of the switching devices 5A, 5B, and 5C. Therefore, the lengths of the signal sub-lines 12A, 12B, and 12C differ because the positions of the switching devices 5A, 5B, and 5C differ depending on the dots 4A, 4B, and 4C.

Unlike the liquid-crystal display apparatus according to the fifth embodiment, the liquid crystal display apparatus according to the present-embodiment has a structure in which the switching devices 5A, 5B, and 5C and the display electrodes 8R, 8G, and 8B overlap vertically in the process layer stack. Since the numbers of the switching devices 5A, 5B, and 5C which overlap with the display electrodes 8R, 8G, and 8B are equal for all the display electrodes 8R, 8G, and 8B, however, the dispersion of the capacitances of the parasitic capacitors formed by the display electrodes 8R, 8G, and 8B and the switching devices 5A, 5B, and 5C are suppressed, and the dispersion of the offset voltage is also suppressed. As a result, the same advantage as that in the fifth embodiment is obtained, in which display problems such as flicker and burning are alleviated while design flexibility is maintained.

Since it is required in the fifth embodiment to arrange the switching devices 5 and the display electrodes 8R, 8G, and 8B so as not to overlap with each other, the distances between the adjacent display electrodes 8R, 8G, and 8B differ between a location where there is no switching device 5 and a location where there is a switching device 5. For example, the distance between the display electrode 8R and the display electrode 8G and the distance between the display electrode 8G and the display electrode 8B are short whereas the distance between the display electrode 8B and the display electrode 8R is long. As a result, interference with threads of a light guide plate causes moiré in cases such as a case in which a front light is placed on the upper surface of the liquid-crystal display apparatus, and problems such as unattractive appearance occur. In addition, since a black matrix is usually disposed at a position where a switching device 5 is disposed, the position cannot be used for display, an area (aperture ratio) for display becomes small, and an image is darkened. Contrarily, in the liquid crystal display apparatus according to the present embodiment, since the structure is used in which the switching devices 5 and the display electrodes 8R, 8G, and 8B overlap, the portions sandwiched by the display electrodes 8R, 8G, and 8B, which cannot be used for display, can be narrowed to have the same width irrespective of their positions. Therefore, an attractive-looking, bright image can be displayed.

Seventh Embodiment

A liquid-crystal display apparatus according to a seventh embodiment of the present invention will be described below by referring to FIG. 14 and FIG. 15.

The basic structure of the liquid-crystal display apparatus according to the present embodiment is almost the same as in the fifth and sixth embodiments. FIG. 15 is a plan showing only dot electrodes 6A, 6B, and 6C of the liquid-crystal display apparatus, and FIG. 14 is a plan further showing display electrodes 8R, 8G and 8B placed above the dot electrodes 6A, 6B, and 6C together with the dot electrodes. In FIG. 14 and FIG. 15, the same symbols as those used in FIG. 11 and FIG. 2 are assigned to the same components as those shown in FIG. 11 and FIG. 2, and detailed descriptions thereof are omitted.

Figure 14:
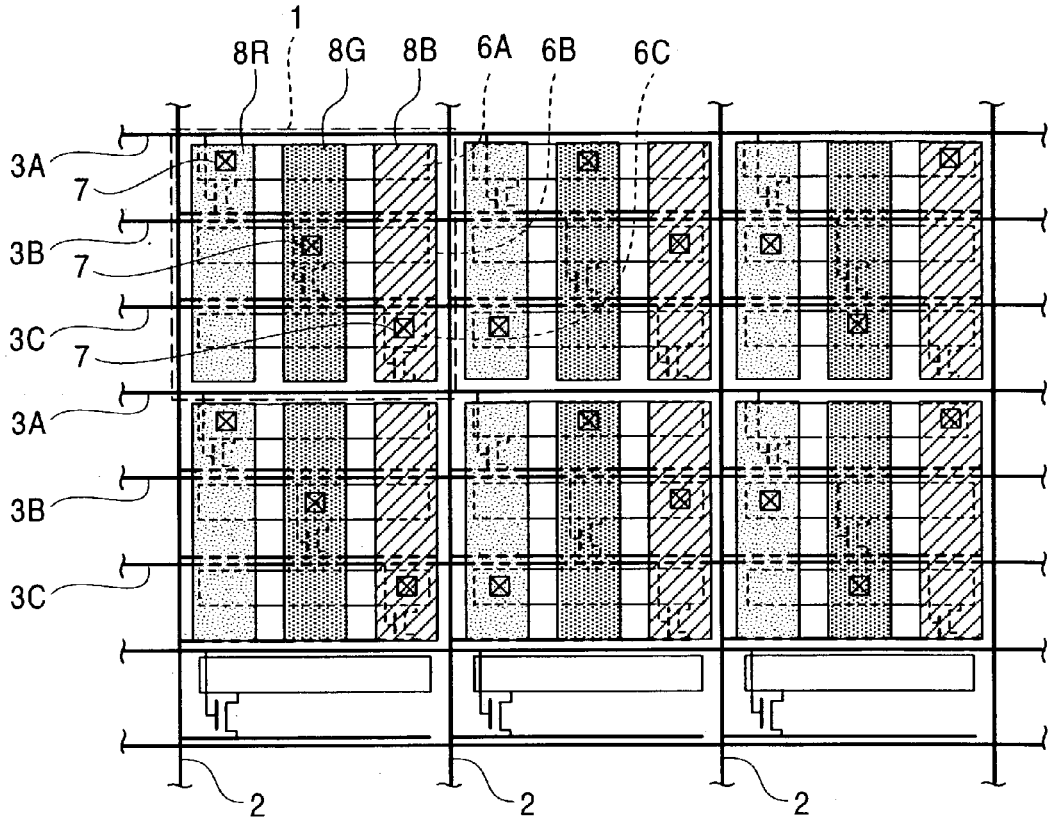
FIG. 14 is a plan showing, in an overlapping manner, dot electrodes and display electrodes disposed thereabove in an active-matrix substrate of a liquid-crystal display apparatus according to a seventh embodiment of the present invention.
Figure 15:
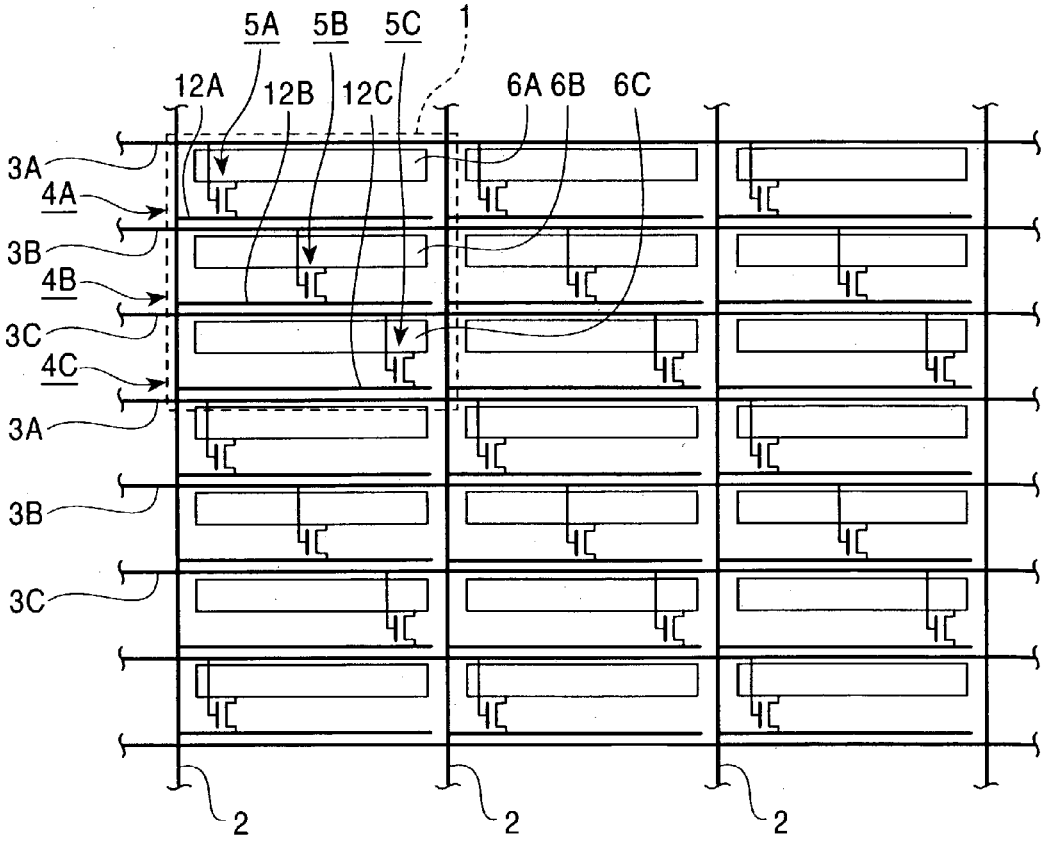
FIG. 15 is a plan showing only the dot electrodes in the active-matrix substrate of the liquid-crystal display apparatus according to the seventh embodiment of the present invention.

Whereas all the switching devices 5 and any display electrodes 8R, 8G, and 8B do not overlap with each other vertically in the process layer stack in the liquid-crystal display apparatus according to the fifth embodiment, three switching devices 5A, 5B, and 5C in one color pixel 1 and three display electrodes 8R, 8G, and 8B in the color pixel 1 overlap vertically in the process layer stack, respectively, in the liquid-crystal display apparatus according to the present embodiment in the same way as in the sixth embodiment, as shown in FIG. 14 and FIG. 15. In one color pixel 1, the three switching devices 5A, 5B, and 5C overlap with the different display electrodes 8R, 8G, and 8B, respectively. The numbers of the switching devices 5A, 5B, and 5C which overlap with the display electrodes 8R, 8G, and 8B are equal for all the display electrodes 8R, 8G, and 8B.

The liquid-crystal display apparatus according to the present embodiment differs from the liquid-crystal display apparatus according to the sixth embodiment in that the orientation of the switching devices is rotated by 90 degrees. More specifically, whereas the direction in which the sources, gates, and drains of the TFTs serving as the switching devices 5A, 5B, and 5C are arranged is the direction in which the scanning lines 3A, 3B, and 3C are extended in the sixth embodiment, the direction in which the sources, gates, and drains of the TFTs are arranged is the direction in which the signal line 2 is extended in the present embodiment, as shown in FIG. 15. Signal sub-lines 12A, 12B, and 12C branched from the signal line 2 are provided in the dots 4A, 4B, and 4C such that the signal sub-lines are extended to ends of the dots 4A, 4B, and 4C in the direction in which the scanning lines 3A, 3B, and 3C are extended, and the signal sub-lines have the same length in all of the dots 4A, 4B, and 4C. The sources of the TFTs are connected to the signal sub-lines 12A, 12B, and 12C partway, and the gates thereof are connected to the scanning lines 3A, 3B, and 3C.

The liquid-crystal display apparatus according to the present embodiment also has a structure in which the numbers of the switching devices 5A, 5B, and 5C Which overlap with the display electrodes 8R, 8G, and 8B are equal for all of the display electrodes 8R, 8G, and 8B, the dispersion of the capacitances of the parasitic capacitors formed by the display electrodes 8R, 8G, and 8B and the switching devices 5A, 5B, and 5C are suppressed, and therefore, the dispersion of the offset voltage is also suppressed. As a result, the same advantage as that in the sixth embodiment is obtained, in which display problems such as flicker and burning are alleviated while design flexibility is maintained.

Since the lengths of the signal sub-lines 12A, 12B, and 12C differ depending on the dots 4A, 4B, and 4C in the sixth embodiment, the capacitances of the parasitic capacitors formed by the display electrodes 8R, 8G, and 8B and the signal sub-lines 12A, 12B, and 12C differ depending on the dots 4A, 4B, and 4C. Contrarily, in the present embodiment, the lengths of the signal sub-lines 12A, 12B, and 12C are equal in all of the dots 4A, 4B, and 4C, and the areas where the display electrodes 8R, 8G, and 8B and the signal sub-lines 12A, 12B, and 12C overlap are equal for all of the dots 4A, 4B, and 4C. Therefore, the dispersion of the capacitances of the parasitic capacitors can be further suppressed to further improve display quality.

Eighth Embodiment

A liquid-crystal display apparatus according to an eighth embodiment of the present invention will be described below by referring to FIG. 16 and FIG. 17.

The basic structure of the liquid-crystal display apparatus according to the present embodiment is almost the same as in the fifth to seventh embodiments. FIG. 17 is a plan showing only dot electrodes 6A, 6B, and 6C of the liquid-crystal display apparatus, and FIG. 16 is a plan further showing display electrodes 8R, 8G and 8B placed above the dot electrodes 6A, 6B, and 6C together with the dot electrodes. In FIG. 16 and FIG. 17, the same symbols as those used in FIG. 11 and FIG. 2 are assigned to the same components as those shown in FIG. 11 and FIG. 2, and detailed descriptions thereof are omitted.

Figure 16:
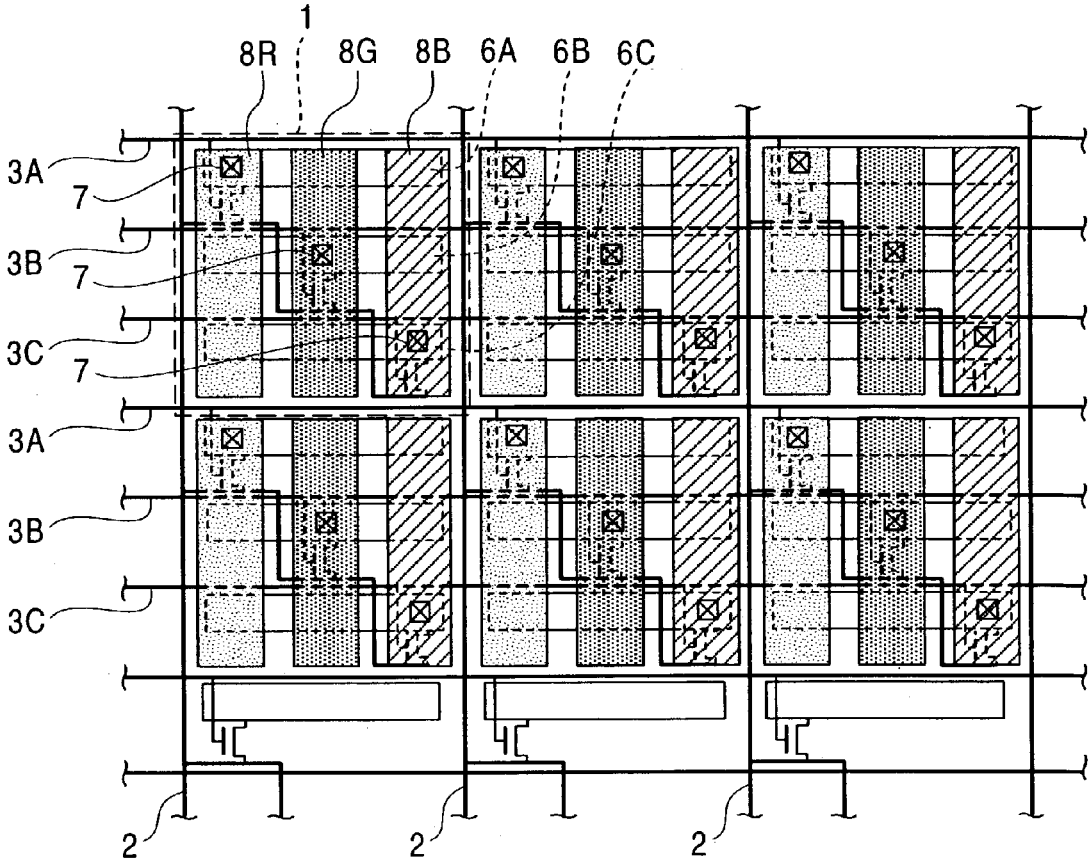
FIG. 16 is a plan showing, in an overlapping manner, dot electrodes and display electrodes disposed thereabove in an active-matrix substrate of a liquid-crystal display apparatus according to an eighth embodiment of the present invention.
Figure 17:
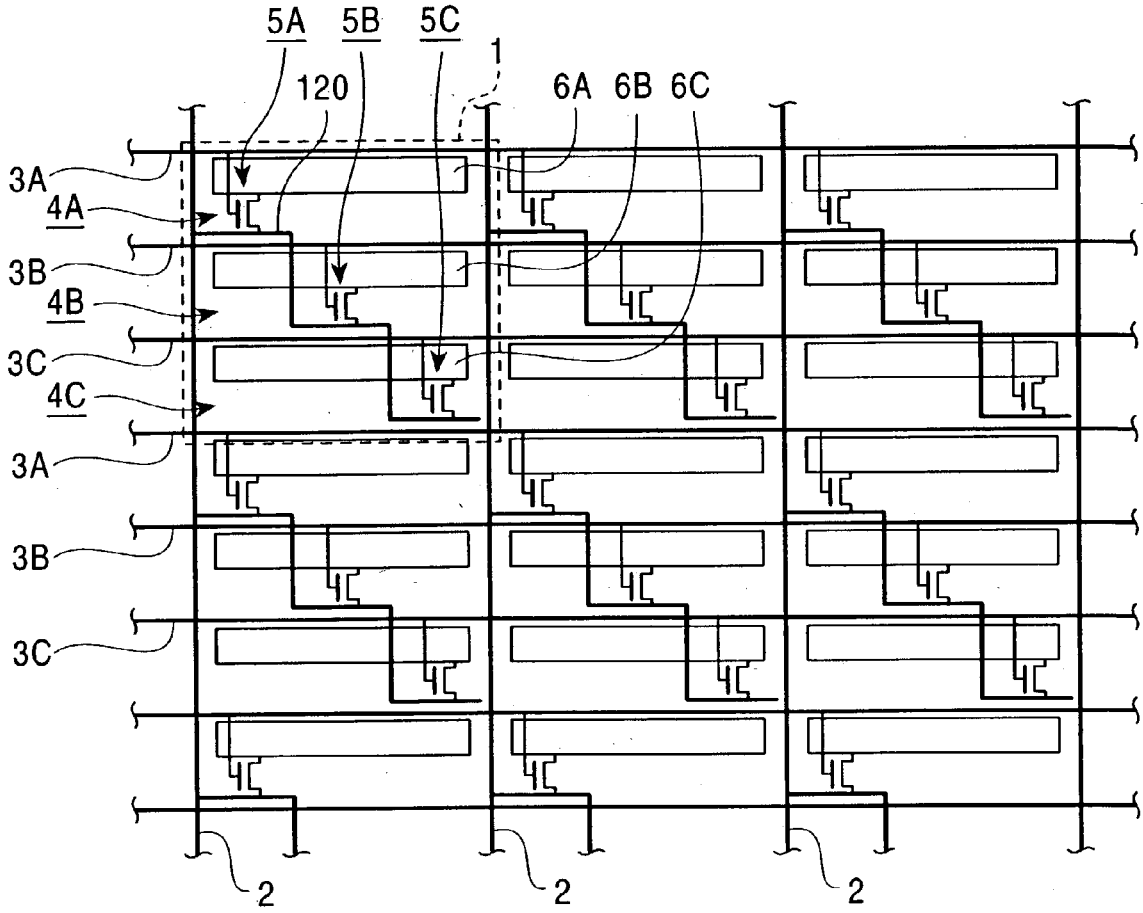
FIG. 17 is a plan showing only the dot electrodes in the active-matrix substrate of the liquid-crystal display apparatus according to the eighth embodiment of the present invention.

In the liquid-crystal display apparatus according to the present embodiment, in the same way as in the sixth and seventh embodiments, three switching devices 5A, 5B, and 5C in one color pixel 1 and three display electrodes 8R, 8G, and 8B in the color pixel 1 overlap vertically in the process layer stack, respectively, as shown in FIG. 16 and FIG. 17. In one color pixel 1, the three switching devices 5A, 5B, and 5C overlap with the different display electrodes 8R, 8G, and 8B, respectively. The numbers of the switching devices 5A, 5B, and 5C which overlap with the display electrodes 8R, 8G, and 8B are equal for all of the display electrodes 8R, 8G, and 8B. In addition, in the same way as in the seventh embodiment, the sources, gates, and drains of the TFTs serving as the switching devices 5A, 5B, and 5C are arranged in the direction in which the signal lines 2 are extended.

The liquid-crystal display apparatus according to the present embodiment differs from the liquid-crystal display apparatus according to the seventh embodiment in that, whereas the signal sub-lines 12A, 12B, and 12C are provided in the dots 4A, 4B, and 4C, one for each, and are extended to ends of the dots in the direction in which the scanning lines 3A, 3B, and 3C are extended in the seventh embodiment, as shown in FIG. 17, one signal sub-line 120 which bend like stairs is provided through three dots 4A, 4B, and 4C in one color pixel 1 in the present embodiment, as shown in FIG. 17. The sources of the TFTs serving as the three switching devices 5A, 5B, and 5C corresponding to three dot electrodes 6A, 6B, and 6C are connected to the signal sub-line 120 partway, and the gates thereof are connected to the scanning lines 3A, 3B, and 3C.

Since the liquid-crystal display apparatus according to the present embodiment also has a structure in which the numbers of the switching devices 5A, 5B, and 5C which overlap with the display electrodes 8R, 8G, and 8B are equal for all of the display electrodes 8R, 8G, and 8B, the dispersion of the capacitances of the parasitic capacitors formed by the display electrodes 8R, 8G, and 8B and the switching devices 5A, 5B, and 5C are suppressed, and therefore, the dispersion of the offset voltage is also suppressed. As a result, the same advantage as that in the sixth and seventh embodiments is obtained, in which display problems such as flicker and burning are alleviated while design flexibility is maintained.

Whereas the three signal sub-lines 12A, 12B, and 12C intersect with each of the display electrodes 8R, 8G, and 8B in the seventh embodiment, only the one signal sub-line 120 intersects with each of the display electrodes 8R, 8G, and 8B in the present embodiment because the one signal sub-line 120 has a stairs shape. Therefore, the area where the signal sub-line 120 and the display electrodes 8R, 8G, and 8B overlap is reduced, compared with the seventh embodiment. Not only the dispersion of the capacitances of the parasitic capacitors but also the capacitances themselves can be reduced. A driving circuit can be designed simply, flicker and burning are suppressed, and cross talk is also suppressed.

Ninth Embodiment

A liquid-crystal display apparatus according to a ninth embodiment of the present invention will be described below by referring to FIG. 18 and FIG. 19.

The basic structure of the liquid-crystal display apparatus according to the present embodiment is almost the same as in the fifth to eighth embodiments. FIG. 19 is a plan showing only dot electrodes 6A, 6B, and 6C of the liquid-crystal display apparatus, and FIG. 18 is a plan further showing display electrodes 8R, 8G and 8B placed above the dot electrodes 6A, 6B, and 6C together with the dot electrodes. In FIG. 18 and FIG. 19, the same symbols as those used in FIG. 11 and FIG. 2 are assigned to the same components as those shown in FIG. 11 and FIG. 2, and detailed descriptions thereof are omitted.

Figure 18:
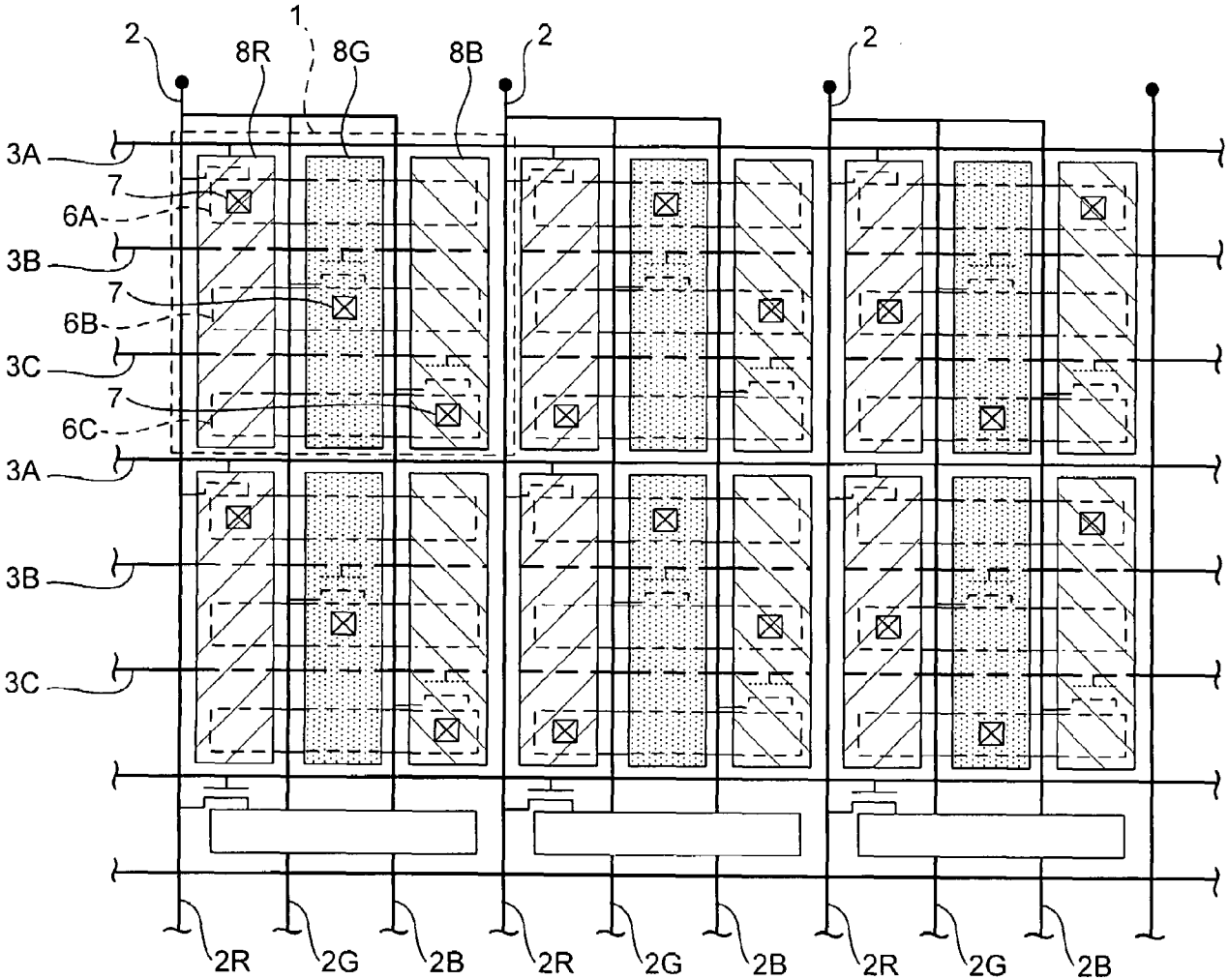
FIG. 18 is a plan showing, in an overlapping manner, dot electrodes and display electrodes disposed thereabove in an active-matrix substrate of a liquid-crystal display apparatus according to a ninth embodiment of the present invention.
Figure 19:
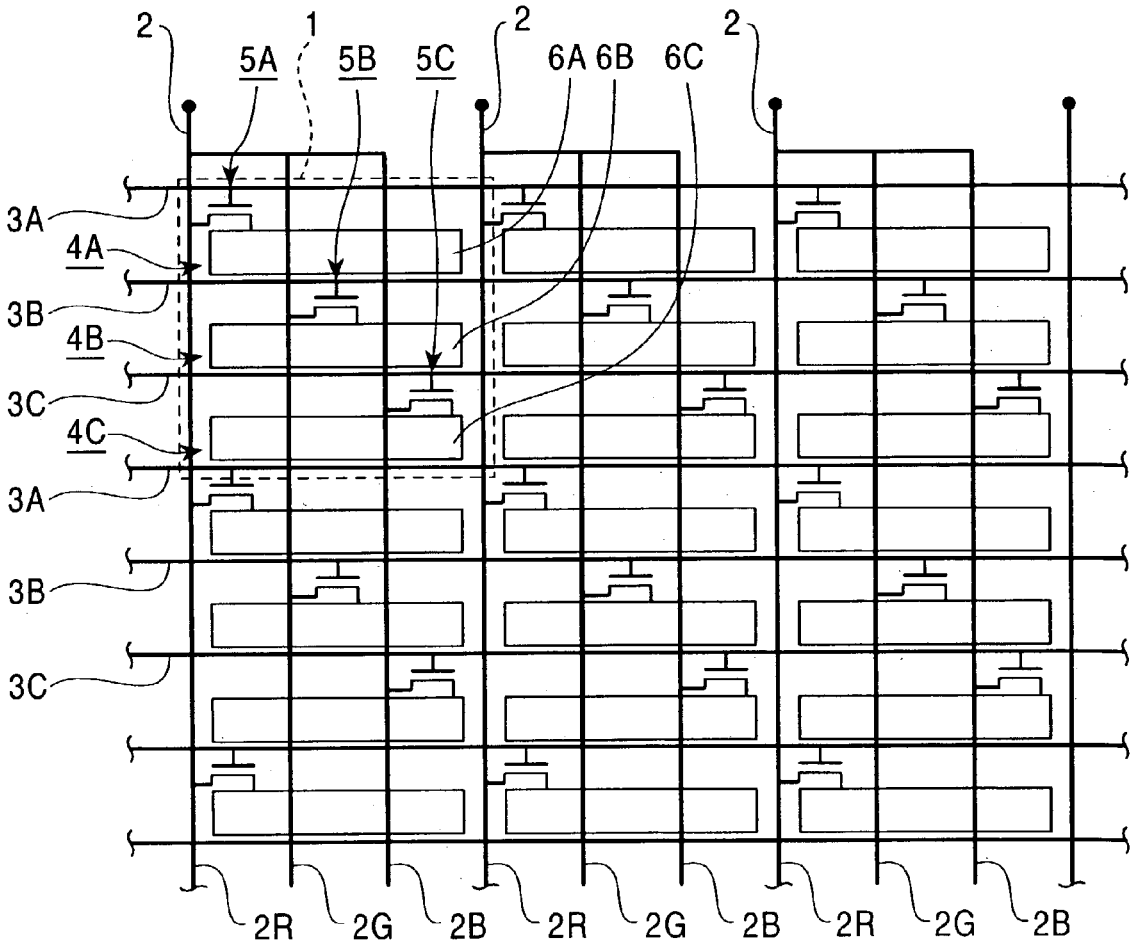
FIG. 19 is a plan showing only the dot electrodes in the active-matrix-substrate of the liquid-crystal display apparatus according to the ninth embodiment of the present invention.

The liquid-crystal display apparatus according to the present embodiment has, as shown in FIG. 18 and FIG. 19, the same arrangement of switching devices 5A, 5B, and 5C as the liquid-crystal display apparatus in the sixth embodiment shown in FIG. 12 and FIG. 13. In other words, three switching devices 5A, 5B, and 5C in one color pixel 1 and three display electrodes 8R, 8G, and 8B in the color pixel 1 overlap vertically in the process layer stack, respectively, and the numbers of the switching devices 5A, 5B, and 5C which overlap with the display electrodes 8R, 8G, and 8B (one for each) are equal for all of the display electrodes 8R, 8G, and 8B.

The liquid-crystal display apparatus according to the present embodiment differs from the liquid-crystal display apparatus according to the sixth embodiment in terms of the structure of signal lines 2. The signal sub-lines 12A, 12B, and 12C branched from a signal line 2 and having different lengths are provided in dots 4A, 4B, and 4C, as shown in FIG. 13, in the sixth embodiment. Contrarily, in the present embodiment, as shown in FIG. 19, a signal line 2 corresponding to dot electrodes 6A, 6B, and 6C arranged in line vertically in the figure are divided into three signal lines close to the root, and the three signal lines 2R, 2G, and 2B, branched from the signal line 2, are connected to the three switching devices 5A, 5B, and 5C corresponding to the dot electrodes 6A, 6B, and 6C in one color pixel 1.

Since the liquid-crystal display apparatus according to the present embodiment also has a structure in which the numbers of the switching devices 5A, 5B, and 5C which overlap with the display electrodes 8R, 8G, and 8B are equal for all of the display electrodes 8R, 8G, and 8B, the dispersion of the capacitances of the parasitic capacitors formed by the display electrodes 8R, 8G, and 8B and the switching devices 5A, 5B, and 5C are suppressed, and therefore, the dispersion of the offset voltage is also suppressed. As a result, the same advantage as that in the sixth to eighth embodiments is obtained, in which display problems such as flicker and burning are alleviated while design flexibility is maintained. In addition, according to the structure of the present embodiment, the capacitances of parasitic capacitors which include not only those formed between the switching devices 5A, 5B, and 5C and the signal sub-lines, and the display electrodes 8R, 8G, and 8B but also those formed between the signal lines 2R, 2G, and 2B and the display electrodes 8R, 8G, and 8B are made equal. The dispersion of the capacitances of the parasitic capacitors is reduced to the minimum among all embodiments to improve display quality.

Tenth Embodiment

A liquid-crystal display apparatus according to a tenth embodiment of the present invention will be described below by referring to FIG. 20A, FIG. 20B, FIG. 21, and FIG. 22.

Figure 20A:
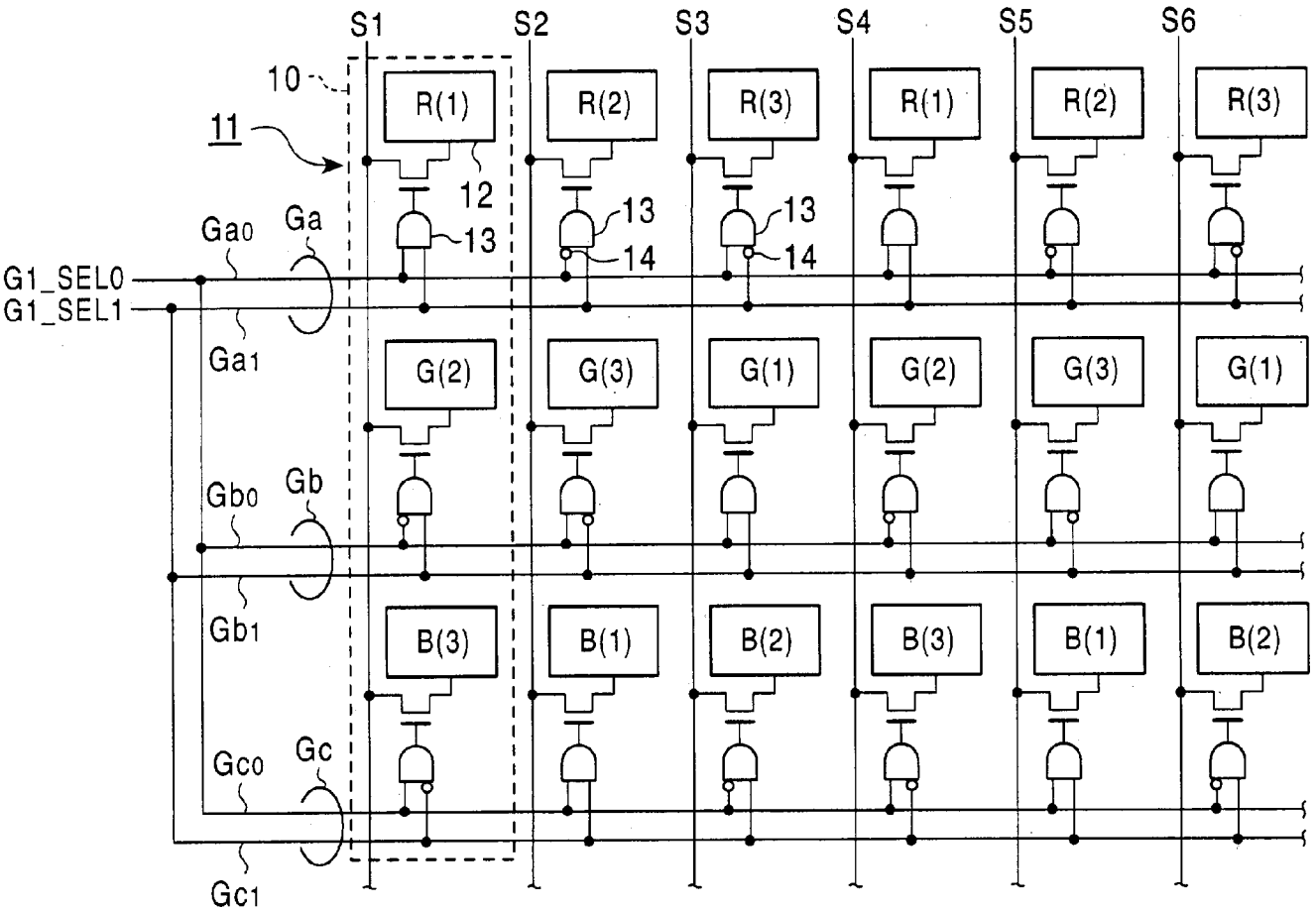
FIG. 20A is an outlined structural view of a TFT array substrate of a liquid-crystal display apparatus according to a tenth embodiment of the present invention.
Figure 21:
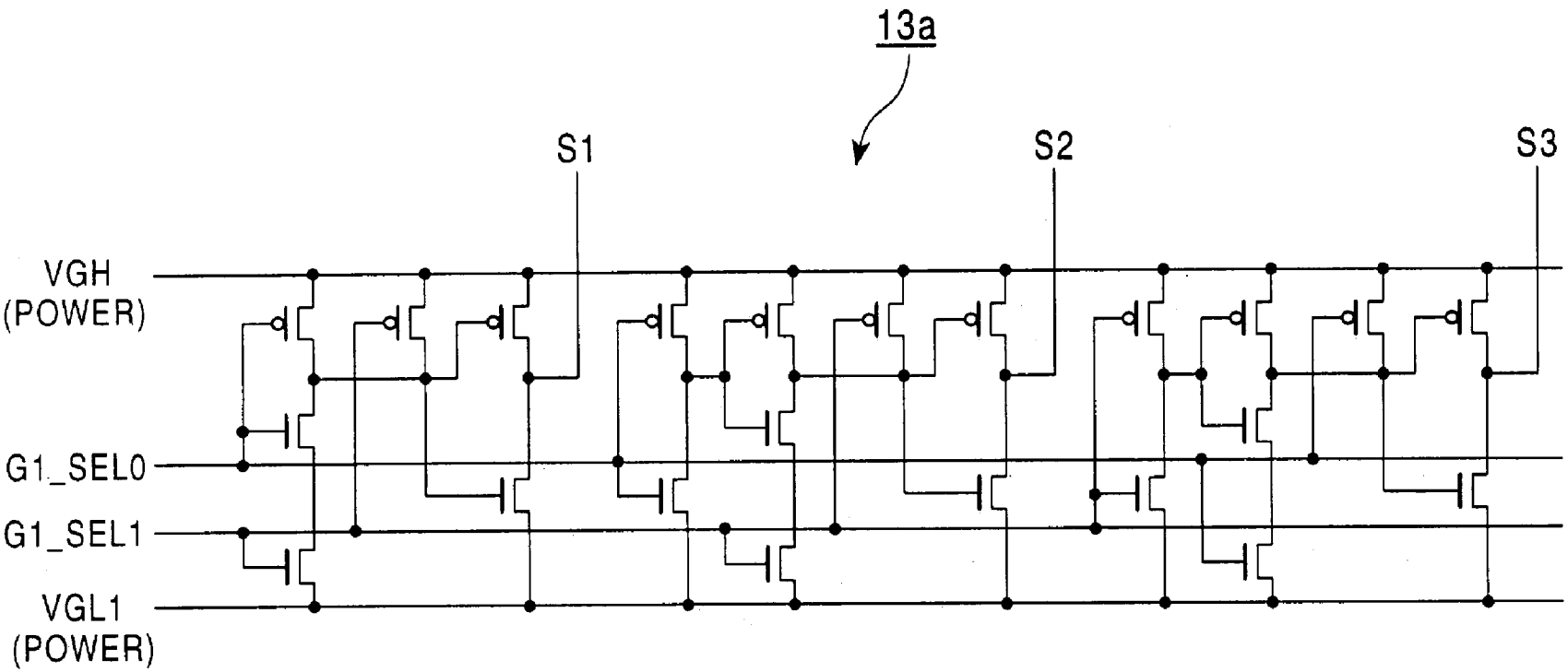
FIG. 21 is a view showing an example specific circuit structure of the selection circuits in the liquid-crystal display apparatus according to the tenth embodiment.
Figure 22:
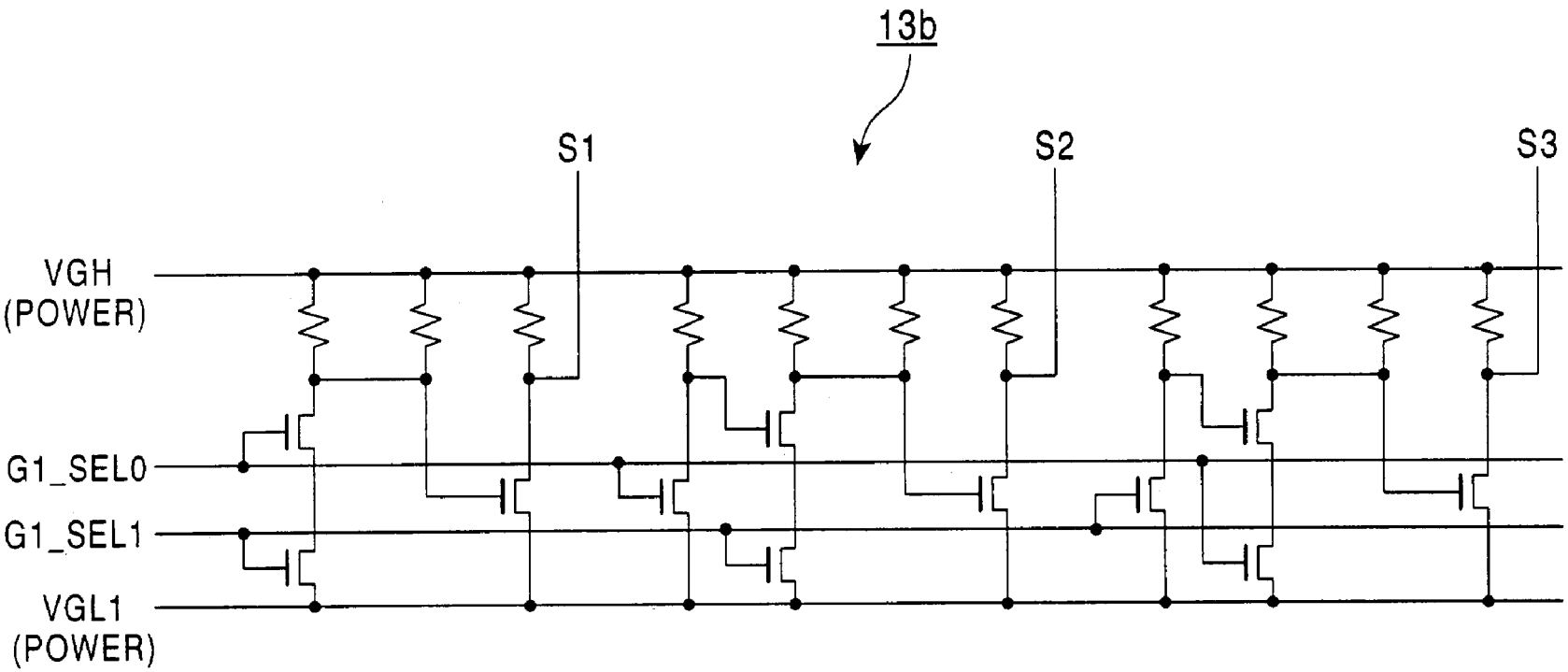
FIG. 22 is a view showing another example specific circuit structure of the selection circuits in the liquid-crystal display apparatus according to the tenth embodiment.

FIG. 20A is a view showing an outlined structure of a TFT array substrate of the active-matrix liquid-crystal display apparatus according to the present embodiment. FIG. 20B is a truth table of a selection circuit provided for the TFT array substrate. FIG. 21 and FIG. 22 are views showing example specific circuit structures of a selection circuit used in the present embodiment.

As shown in FIG. 20A, the liquid-crystal display apparatus according to the present embodiment has, on the TFT array substrate, a plurality of signal lines S1, S2, . . . and a plurality of scanning lines Ga0, Ga1, Gb0, Gb1, Gc0, Gc1, . . . The plurality of scanning lines is divided into a plurality of scanning-line groups Ga, Gb, and Gc each formed of a pair of scanning lines (only three groups are shown in FIG. 20A). Pixels 10 formed of dots R(1) to R(3), G(1) to G(3), and B(1) to B(3) corresponding to the R, G, and B basic colors are arranged in a matrix manner. In other words, the dots R(1) to R(3), G(1) to G(3), and B(1) to B(3) are formed at the areas enclosed by adjacent signal lines S1, S2, . . . and adjacent scanning-line groups Ga, Gb, and Gc.

Each dot includes a TFT 11 driven by one of the signal lines S1, S2, . . . and the plurality of scanning lines Ga0, Ga1, Gb0, Gb1, Gc0, Gc1, . . . constituting one set of scanning-line groups Ga, Gb, and Gc; and a dot electrode 12 electrically connected to the TFT 11. In this TFT array substrate, one pixel 10 is formed of three dots vertically arranged and corresponding to the R, G, and B basic colors, among the dots R(1) to R(3), G(1) to G(3), and B(1) to B(3). The TFT array substrate is used by the tripled scanning line method.

Selection circuits 13 each having two inputs and one output are provided between the TFTs 11 and one set of scanning-line groups Ga, Gb, and Gc corresponding to the dots R(1) to R(3), G(1) to G(3), and B(1) to B(3), each set of dots arranged in line horizontally. The two inputs of a selection circuit 13 are connected to different scanning lines among the pairs of scanning lines Ga0, Ga1, Gb0, Gb1, Gc0, and Gc1 constituting one set of scanning-line groups Ga, Gb, and Gc, and the output of the selection circuit 13 is connected to the gate electrode of the corresponding TFT 11. In the present embodiment, specifically, the selection circuits 13 are formed of NAND logical circuits. For example, selection circuits 13*a* shown in FIG. 21 are formed of two-input CMOS NAND circuits using polycrystalline-silicon TFTs, and selection circuits 13*b* shown in FIG. 22 are formed of two-input NMOS NAND circuits using amorphous-silicon TFTs.

In the three scanning-line groups Ga, Gb, and Gc shown in FIG. 20A, upper scanning lines Ga0, Gb0, and Gc0 of the scanning-line groups are electrically connected to each other, and lower scanning lines Ga1, Gb1, and Gc1 of the scanning-line groups are electrically connected to each other. In all of the scanning-line groups Ga, Gb, and Gc constituting one set of scanning-line groups, a scanning signal is sent to the upper scanning lines, and another scanning signal is sent to the lower scanning lines, such as in a case in which signal G1_SEL0 is sent to the upper scanning lines Ga0, Gb0, and Gc0 and signal G1_SEL1 is sent to the lower scanning lines Ga1, Gb1, and Gc1. In some dots, inverters 14 are connected to an input of the selection circuits 13. Whether an inverter 14 is connected and its connection point differ between adjacent dots.

For example, among the dots R(1), R(2), and R(3) arranged horizontally in the uppermost row in FIG. 20A, the dot R(1) has no inverter 14, the dot R(2) has an inverter 14 inserted to the input from the upper scanning line Ga0, and the dot R(3) has an inverter 14 inserted to the input from the lower scanning line Ga1. With this structure, signals G1_SEL0 and G1_SEL1 are input as they are to the selection circuit 13 of the dot R(1), signal G1_SEL1 and the signal obtained by inverting the polarity of signal G1_SEL0 are input to the selection circuit 13 of the dot R(2), and signal G1_SEL0 and the signal obtained by inverting the polarity of signal G1_SEL1 are input to the selection circuit 13 of the dot R(3). The point that whether an inverter 14 is provided and its position differ between adjacent dots is also applied to dots arranged vertically (dots having different colors).

With the above-described structure, the TFT 11 of one of the dots R(1) to R(3), G(1) to G(3), and B(1) to B(3) is scanned at a period different from that for the TFT 11 of a dot adjacent to the one dot in the liquid-crystal display apparatus according to the present embodiment. This point will be described below by referring to FIG. 20B.

FIG. 20B shows a truth table of the selection circuits 13. This truth table indicates that, among the dots R(1) to R(3), G(1) to G(3), and B(1) to B(3) shown in FIG. 20A, whether the TFTs 11 of the dots R(1), G(1), and B(1) having (1) are on or off, whether the TFTs 11 of the dots R(2), G(2), and B(2) having (2) are on or off, and whether the TFTs 11 of the dots R(3), G(3), and B(3) having (3) are on or off, when signals G1_SEL0 and G1_SEL1 are set to high or low, respectively.

As described above, for example, since signals G1_SEL0 and G1_SEL1 are input as they are into the selection circuits 13 of the dots R(1), G(1), and B(1) having (1), the TFTs 11 are on only when signals G1_SEL0 and G1_SEL1 are both high, and are off in the other cases. Since signal G1_SEL1 and the signal obtained by inverting the polarity of signal G1_SEL0 are input to the selection circuits 13 of the dots R(2), G(2), and B(2) having (2), the TFTs 11 are on only when signal G1_SEL0 is low and signal G1_SEL1 is high, and are off in the other cases. Since signal G1_SEL0 and the signal obtained by inverting the polarity of signal G1_SEL1 are input to the selection circuits 13 of the dots R(3), G(3), and B(3) having (3), the TFTs 11 are on only when signal G1_SEL0 is high and signal G1_SEL1 is low, and are off in the other cases.

Therefore, when signals G1_SEL0 and G1_SEL1 are both high, the TFTs 11 of the dots R(1), G(1), and B(1) are turned on and image signals are written. When signal G1_SEL0 is low and signal G1_SEL1 is high, the TFTs 11 of the dots R(2), G(2), and B(2) are turned on and image signals are written. When signal G1_SEL0 is high and signal G1_SEL1 is low, the TFTs 11 of the dots R(3), G(3), and B(3) are turned on and image signals are written. Consequently, signals are written into the entire screen in three scanning periods. In the present embodiment, the TFTs of adjacent dots are scanned at different periods in this way.

According to the liquid-crystal display apparatus according to the present embodiment, since the TFTs 11 of adjacent dots are scanned at different periods, driving is achieved such that adjacent dots have different polarities even with the common inversion driving method. As a result, dot inversion driving is implemented. Therefore, while the tripled scanning line method and the common inversion driving method are employed to reduce power consumption, dot inversion driving is achieved in terms of display. Consequently, the time frequency of flicker is made larger than in conventional cases, and line crawling (flicker) is made difficult to visually recognize. In addition, a black straight line is displayed without ridges and steps at high quality.

Especially in the present embodiment, since the selection circuits 13 are located in pixel areas, the number of scanning lines in the TFT array substrate does not need to be increased greatly. Further, since a pair of scanning lines is used as a set, and the selection circuits each having two inputs and one output are employed, the above-described advantages are obtained with the minimum number of scanning lines and the minimum number of selection circuits. The scale of the selection circuits is also reduced.

Eleventh Embodiment

A liquid-crystal display apparatus according to an eleventh embodiment of the present invention will be described below by referring to FIG. 23A and FIG. 23B.

Figure 23A:
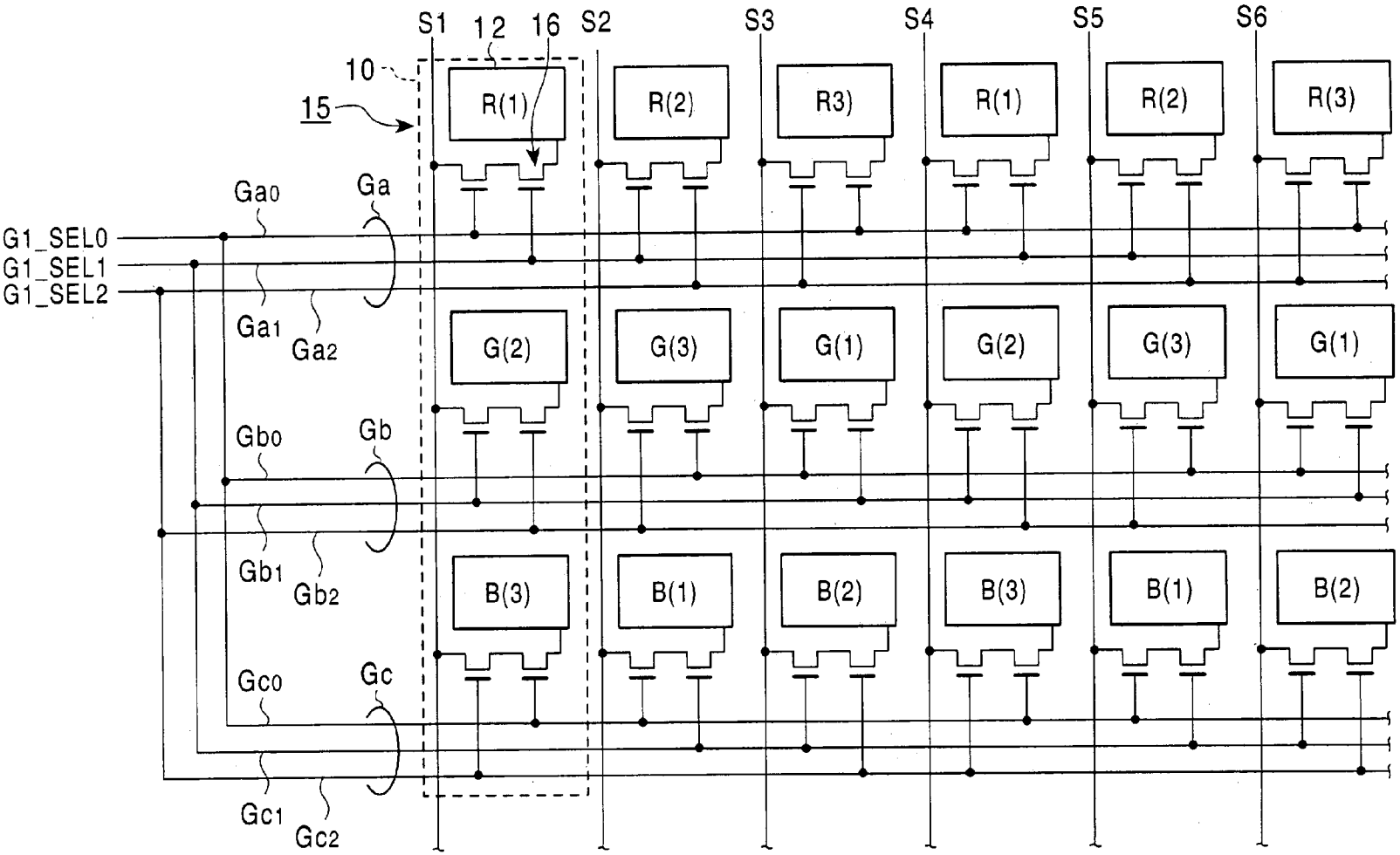
FIG. 23A is an outlined structural view of a TFT array substrate of a liquid-crystal display apparatus according to an eleventh embodiment of the present invention.

FIG. 23A is a view showing an outlined structure of a TFT array substrate of the active-matrix liquid-crystal display apparatus according to the present embodiment. FIG. 23B shows a table indicating the relationship between signals input to scanning lines and outputs to dot electrodes.

As shown in FIG. 23A, the liquid-crystal display apparatus according to the present embodiment has, on the TFT array substrate, a plurality of signal lines S1, S2, . . . and a plurality of scanning lines Ga0 to Ga2, Gb0 to Gb2, and Gc0 to Gc2. The plurality of scanning lines Ga0 to Ga2, Gb0 to Gb2, and Gc0 to Gc2 is divided into a plurality of scanning-line groups Ga, Gb, and Gc each formed of three scanning lines (only three groups are shown in FIG. 23A). Pixels 10 formed of dots R(1) to R(3), G(1) to G(3), and B(1) to B(3) corresponding to the R, G, and B basic colors are arranged in a matrix manner. In other words, dots are formed at the areas enclosed by adjacent signal lines S1, S2, . . . and adjacent scanning-line groups Ga, Gb, and Gc. One pixel 10 is formed of three dots arranged vertically and corresponding to the R, G, and B basic colors.

In each of the dots R(1) to R(3), G(1) to G(3), and B(1) to B(3), a dot electrode 12 and TFTs for writing an image signal into the dot electrode 12 are provided. The TFTs are two (less than the number (three in the present embodiment) of scanning lines which constitute a scanning-line group) TFTs 15 and 16 connected in series between the signal line and the dot electrode. The gate electrodes of the two TFTs 15 and 16 in each of the dots R(1) to R(3), G(1) to G(3), and B(1) to B(3) are connected to different scanning lines among three scanning lines Ga0 to Ga2, Gb0 to Gb2, or Gc0 to Gc2 constituting scanning-line groups Ga, Gb, or Gc. The connections between the gate electrodes of the two TFTs 15 and 16 and the three scanning lines Ga0 to Ga2, Gb0 to Gb2, or Gc0 to Gc2 differ between adjacent dots.

For example, among the dots R(1), R(2), and R(3) arranged horizontally in the uppermost row in FIG. 23A, the two TFTs 15 and 16 of the dot R(1) are connected, respectively, to a first scanning line Ga0 (to which signal G1_SEL0 is sent) and a second scanning line Ga1 (to which signal G1_SEL1 is sent), from the top; the two TFTs 15 and 16 of the dot R(2) are connected, respectively, to the second scanning line Ga1 (to which signal G1_SEL1 is sent) and a third scanning line Ga2 (to which signal G1_SEL2 is sent), from the top; and the two TFTs 15 and 16 of the dot R(3) are connected, respectively, to the third scanning line Ga2 and the first scanning line Ga1, from the top. The point that the connections between the gate, electrodes of the two TFTs 15 and 16 and the three scanning lines Ga0 to Ga2, Gb0 to Gb2, or Gc0 to Gc2 differ between adjacent dots is also applied to dots arranged vertically (dots having different colors).

With the above-described structure, the TFTs 15 and 16 of one dot are scanned at periods different from those for the TFTs 15 and 16 of a dot adjacent to the one dot in the liquid-crystal display apparatus according to the present embodiment. This point will be described below by referring to FIG. 23B.

FIG. 23B shows a table indicating the relationship between signals input to scanning lines and outputs to dot electrodes. This table indicates that, among the dots R(1) to R(3), G(1) to G(3), and B(1) to B(3) shown in FIG. 23A, whether the TFTs 15 and 16 of the dots R(1), G(1), and B(1) having (1) are on or off, whether the TFTs 15 and 16 of the dots R(2), G(2), and B(2) having (2) are on or off, and whether the TFTs 15 and 16 of the dots R(3), G(3), and B(3) having (3) are on or off, when signals G1_SEL0, G1_SEL1, and G1_SEL2 sent to the scanning lines Ga0 to Ga2, Gb0 to Gb2, and Gc0 to Gc2 are set to high or low, respectively. In the present embodiment, since the TFTs which drive the dot is formed of the two TFTs 15 and 16 connected in series, the TFTs are on as a whole only when the two TFTs 15 and 16 are on, and the TFTs are off in the other cases.

Therefore, when signal G1_SEL0 is high, signal G1_SEL1 is high, and signal G1_SEL2 is low, the dots R(1), G(1), and B(1) having (1) are turned on and image signals are written; the dots R(2), G(2), and B(2) having (2) are off; and the dots R(3), G(3), and B(3) having (3) are off. When signal G1_SEL0 is low, signal G1_SEL1 is high, and signal G1_SEL2 is high, the dots R(2), G(2), and B(2) having (2) are turned on and image signals are written; the dots R(1), G(1), and B(1) having (1) are off; and the dots R(3), G(3), and B(3) having (3) are off. When signal G1_SEL0 is high, signal G1_SEL1 is low, and signal G1_SEL2 is high, the dots R(3), G(3), and B(3) having (3) are turned on and image signals are written; the dots R(1), G(1), and B(1) having (1) are off; and the dots R(2), G(2), and B(2) having (2) are off. Consequently, signals are written into the entire screen in three scanning periods. In the present embodiment, the TFTs of adjacent dots are scanned in different periods in this way.

Also in the liquid-crystal display apparatus according to the present embodiment, while the tripled scanning line method and the common inversion driving method are employed to reduce power consumption, the same advantages as in the tenth embodiment is obtained, in which line crawling (flicker) is made difficult to visually recognize, and a black straight line is displayed without ridges and steps at high quality.

In addition, in the present embodiment, the above-described structure is implemented only with TFTs without adding complicated selection circuits such as those used in the tenth embodiment. In addition, since the off resistance of the TFTs is higher than that of one TFT, the potential applied to the dot electrode is maintained more successfully. Further, since one scanning-line group is formed of three scanning lines, and two TFTs connected in series are provided for a dot, the above-described advantages are obtained with the minimum number of scanning lines and the minimum number of TFTs.

Twelfth Embodiment

A liquid-crystal display apparatus according to a twelfth embodiment of the present invention will be described below by referring to FIG. 24.

Figure 24:
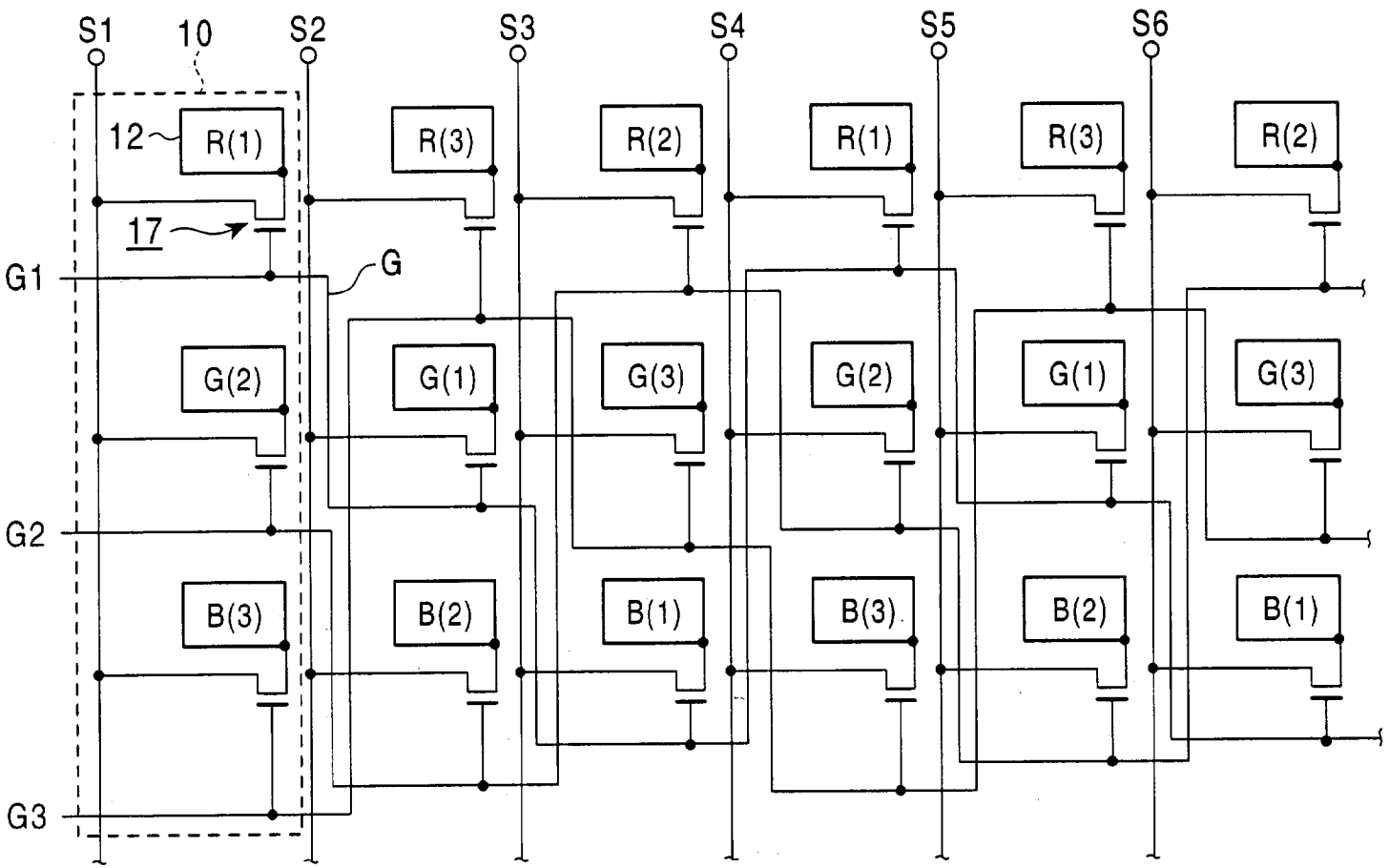
FIG. 24 is an outlined structural view of a TFT array substrate of a liquid-crystal display apparatus according to a twelfth embodiment of the present invention.

FIG. 24 is a view showing an outlined structure of a TFT array substrate of the active-matrix liquid-crystal display apparatus according to the present embodiment.

The liquid-crystal display apparatus according to the present embodiment uses neither selection circuits such as those shown in the tenth embodiment nor a plurality of TFTs connected in series in one dot, such as those shown in the eleventh embodiment. One of scanning lines G1, G2, and G3 and one TFT 17 correspond to each of dots R(1) to R(3), G(1) to G(3), and B(1) to B(3). The TFT 17 is driven by one of signal lines S1, S2, . . . and on eof the scanning lines G1, G2, and G3. A dot electrode 12 electrically connected to the TFT 17 is provided. The wiring patterns of the scanning lines G1, G2, and G3 differ from those in a conventional TFT array substrate. More specifically, whereas scanning lines G1, G2; and G3 are extended horizontally in a straight-line manner in a conventional TFT array substrate which employs the tripled scanning line method, shown in FIG. 27. As shown in FIG. 24, for example, the scanning lines G1, G2, and G3 in the TFT array substrate according to an embodiment of the present invention have sections (e.g. G') extended in the direction in which the signal lines S1, S2, . . . are extended and which are parallel to the signal lines. These parallel sections G' of the scanning lines G1, G2 and G3 weave between a adjacent dot electrodes (e.g. 12).

Figure 27:
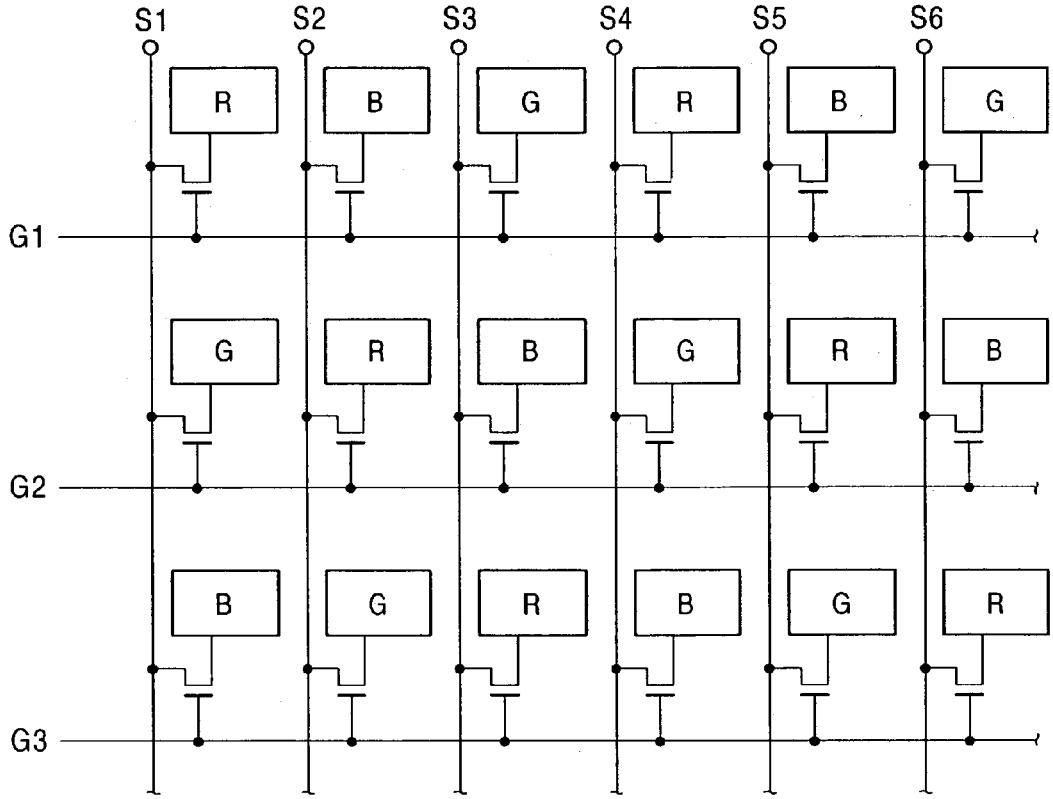
FIG. 27 PRIOR ART
FIG. 27 is an outlined structural view of a TFT array substrate in a liquid-crystal display apparatus which employs a tripled scanning line method.

Whereas dots arranged horizontally are scanned by the same scanning line in a TFT array substrate shown in FIG. 27, according to the present invention (as shown in the embodiment illustrated in FIG. 24, for example), dots arranged horizontally are scanned by different scanning lines in the TFT array substrate since the structure of the scanning lines G1, G2, and G3 differ as described above. For example, in FIG. 24, when a signal is scanned from left to right starting at the left uppermost scanning line G1 the first dot R(1) in first row is illuminated. Next the scanning signal is directed in a parallel direction as the signal lines (S1, S2, S3, etc.) downward toward dot G(1) in the second row to illuminate dot G(1). Then the scanning signal is directed in a parallel direction as the signal lines downward toward dot B(1) in the third row to illuminate dot B(1). Next the scanning signal is directed in a parallel direction as the signal lines upward toward dot R(1) in the first row to illuminate R(1). This wiring pattern is repeated and the scanning line G1 as the scanning continues from left to right. The second scanning line G2 and the third scanning line G3 at the left end of FIG. 24 also have the same wiring pattern. The scanning lines G2 and G3 are sequentially connected to dots in different rows vertically. When the different scanning line G1, G2, and G3 intersect, one scanning line needs to pass over the others through another-layer wiring and a contact hole (not shown).

Also in the liquid-crystal display apparatus according to the present embodiment, while the tripled scanning line method and the common inversion driving method are employed to reduce power consumption, the same advantages as in the tenth and eleventh embodiments are obtained, in which line crawling (flicker) is made difficult to visually recognize, and a black straight line is displayed without ridges and steps at high quality.

Further, since the present embodiment does not need to add selection circuits, unlike the tenth embodiment, an occupied area is not increased. Since the present embodiment does not need to add TFTs, unlike the eleventh embodiment, a reduction in reliability caused by a shift of a threshold voltage is smaller in the present embodiment than in the eleventh embodiment. The wiring pattern of the scanning lines is just required to be changed to implement the apparatus. The number of scanning lines does not need to be increased.

Thirteenth Embodiment

A liquid-crystal display apparatus according to a thirteenth embodiment of the present invention will be described below by referring to FIG. 25 and FIG. 26.

Figure 25:
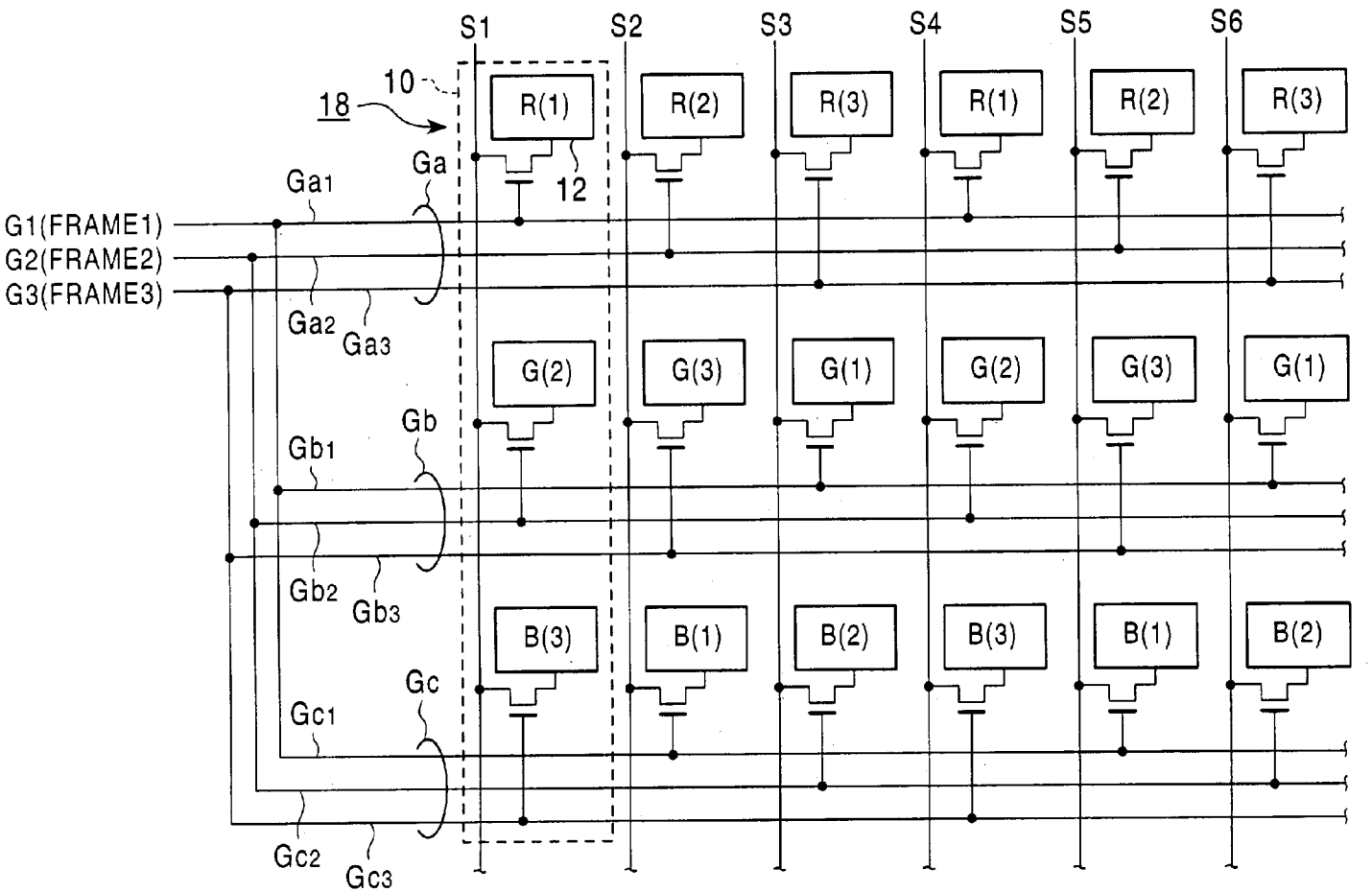
FIG. 25 is an outlined structural view of a TFT array substrate of a liquid-crystal display apparatus according to a thirteenth embodiment of the present invention.
Figure 26:
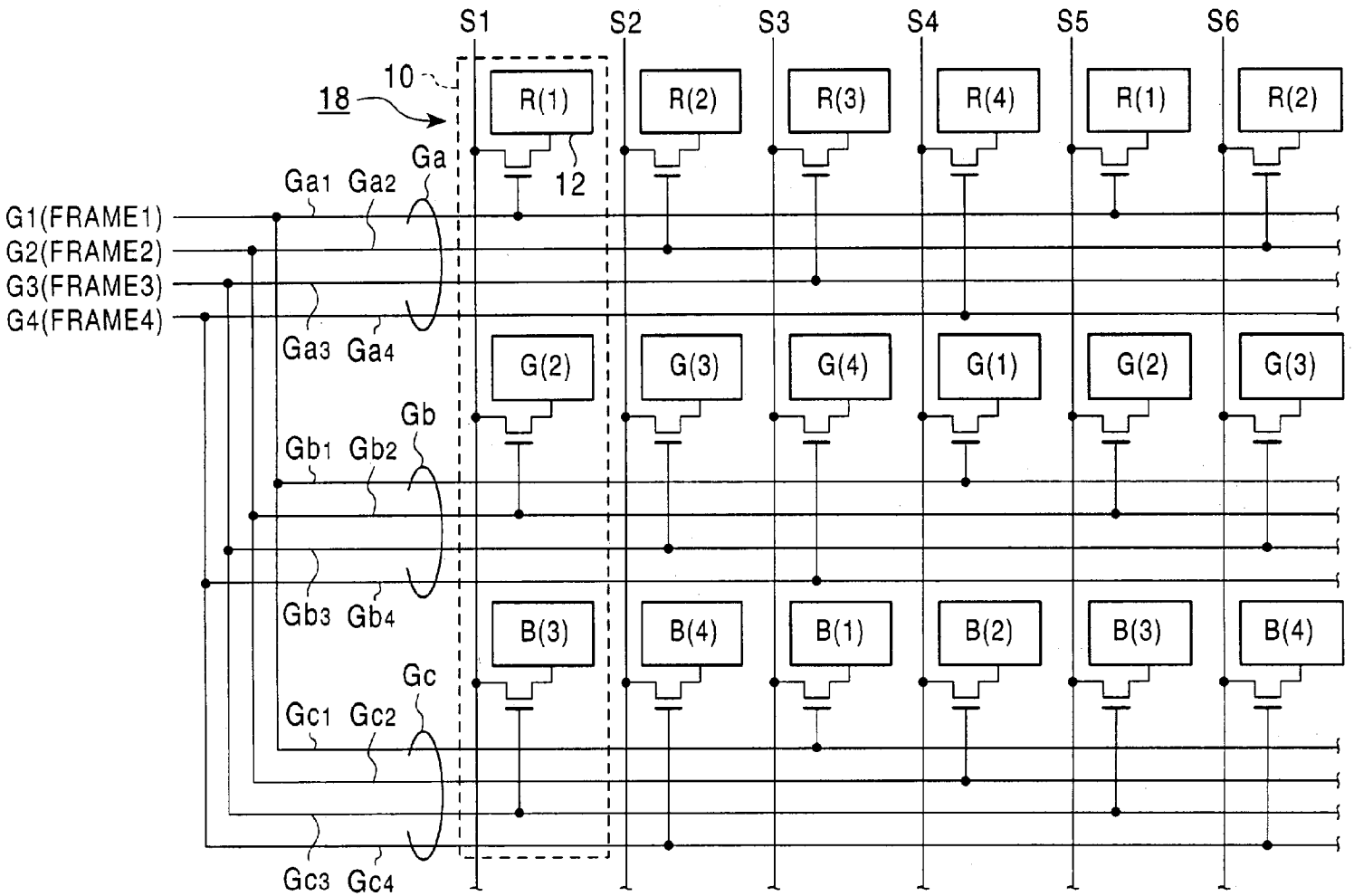
FIG. 26 is an outlined structural view of another TFT array substrate of the liquid-crystal display apparatus according to the thirteenth embodiment of the present invention.

FIG. 25 is a view showing an outlined structure of a TFT array substrate of the active-matrix liquid-crystal display apparatus according to the present embodiment.

As shown in FIG. 25, the liquid-crystal display apparatus according to the present embodiment has, on the TFT array substrate, a plurality of signal lines S1, S2, . . . and a plurality of scanning lines Ga1 to Ga3, Gb1 to Gb3, and Gc1 to Gc3. The plurality of scanning lines Ga1 to Ga3, Gb1 to Gb3, and Gc1 to Gc3 is divided into a plurality of scanning-line groups Ga, Gb, and Gc each formed of three scanning lines (only three groups are shown in FIG. 25). Pixels 10 formed of dots R(1) to R(3), G(1) to G(3), and B(1) to B(3) corresponding to the R, G, and B basic colors are arranged in a matrix manner. In other words, the dots R(1) to R(3), G(1) to G(3), and B(1) to B(3) are formed at the areas enclosed by adjacent signal lines S1, S2, . . . and adjacent scanning-line groups Ga, Gb, and Gc. One pixel 10 is formed of three dots arranged vertically and corresponding to the R, G, and B basic colors among the dots R(1) to R(3), G(1) to G(3), and B(1) to B(3).

In each of the dots R(1) to R(3), G(1) to G(3), and B(1) to B(3), a dot electrode 12 and a TFT 18 for writing an image signal into the dot electrode 12 are provided. The gate electrode of the TFT 18 in each of the dots R(1) to R(3), G(1) to G(3), and B(1) to B(3) is connected to one of the scanning lines Ga1 to Ga3, Gb1 to Gb3, and Gc1 to Gc3 constituting a set of the scanning-line groups Ga, Gb, and Gc. The TFTs 18 of adjacent dots are connected to different scanning lines. In the scanning-line groups Ga, Gb, and Gc, first scanning lines Ga1, Gb1, and Gc1 from the top of the scanning-line groups are electrically connected to each other, second scanning lines Ga2, Gb2, and Gc2 from the top of the scanning-line groups are electrically connected to each other, and third scanning lines Ga3, Gb3, and Gc3 from the top of the scanning-line groups are electrically connected to each other. For the scanning-line groups Ga, Gb, and Gc, an image signal is sent to the first scanning lines Ga1, Gb1, and Gc1 from the top, another image signal is sent to the second scanning lines Ga2, Gb2, and Gc2 from the top, and still another image signal is sent to the third scanning lines Ga3, Gb3, and Gc3 from the top.

For example, among the dots R(1), R(2), and R(3) arranged horizontally in the uppermost row in FIG. 25, the TFT 18 of the dot R(1) is connected to the first scanning line Ga1 from the top; the TFT 18 of the dot R(2) is connected to the second scanning line Ga2 from the top; and the TFT 18 of the dot R(3) is connected to the third scanning line Ga3 from the top. Among the dots G(2), G(3), and G(1) arranged horizontally in the second row from the top in FIG. 25, the TFT 18 of the dot G(2) is connected to the second scanning line Gb2 from the top; the TFT 18 of the dot G(3) is connected to the third scanning line Gb3 from the top; and the TFT 18 of the dot G(1) is connected to the first scanning line Gb1 from the top.

Therefore, when a signal sent to the scanning lines G1 is high, the dots R(1), G(1), and B(1) having (1) are turned on and image signals are written. When a signal sent to the scanning lines G2 is high, the dots R(2), G(2), and B(2) having (2) are turned on and image signals are written. When a signal sent to the scanning lines G3 is high, the dots R(3), G(3), and B(3) having (3) are turned on and image signals are written.; the dots R(1), G(1), and B(1) having (1) are off; and the dots R(2), G(2), and B(2) having (2) are off. Consequently, signals are written into the entire screen in three scanning periods. In the present embodiment, the TFTs of adjacent dots are scanned in different periods in this way.

Also in the liquid-crystal display apparatus according to the present embodiment, while the tripled scanning line method and the common inversion driving method are employed to reduce power consumption, the same advantages as in the tenth to twelfth embodiments are obtained, in which line crawling (flicker) is made difficult to visually recognize, and a black straight line is displayed without ridges and steps at high quality.

In addition, the present embodiment is similar to the twelfth embodiment in that a selection circuit or a TFT does not need to be added. Since the liquid-crystal display apparatus according to the present embodiment has a lower number of intersections of wires than the liquid-crystal display apparatus according to the third embodiment, a defect-occurrence probability caused by a short-circuit at a wire intersection is reduced. Further, since one scanning-line group is formed of three scanning lines, and the corresponding scanning lines in the three scanning-line groups are electrically connected to each other as described above, R, G, and B image signals can be handled collectively, which produces easy handling of the image signals.

In FIG. 25, one scanning-line group is formed of three scanning lines. Instead of this structure, as shown in FIG. 26, a structure may be used, in which scanning-line groups Ga, Gb, and Gc are formed of four scanning lines Ga1 to Ga4, Gb1 to Gb4, and Gc1 to Gc4. Also in this case, the TFTs 18 of dots R(1) to R(4), G(1) to G(4), and B(1) to B(4) adjacent horizontally and vertically need to be connected to different scanning lines.

The technical scope of the present invention is not limited to the above-described embodiments. Various modifications are possible within the range of the gist of the present invention. For example, the descriptions have been made in the above embodiments without mentioning the types of the liquid-crystal display apparatuses, a transmissive type of a reflective type. The present invention is effective for both types as a countermeasure against line crawling, but it may be more easily applied to the reflective type, which has no restriction on the aperture ratio. In addition, since the reflective type does not need a backlight, a reduction in power consumption, produced by common inversion driving is made further large.

In the color-pixel section, dot electrodes can also be used as accumulation capacitors Cs for holding signal voltages. For example, common electrodes for the accumulation capacitors can be formed below the dot electrodes in parallel to the scanning lines to produce the accumulation capacitors through gate insulation films by the common electrodes and the dot electrodes. In this case, a Cs-on-common structure is formed, not a so-called Cs-on-gate structure, and it is suited to common inversion driving. Since the capacitances of capacitors added to the scanning lines are reduced in this structure, when gate drivers are made on the substrate by TFTs, a load is reduced. Therefore, it is advantageous in designing the gate drivers.

In the fifth embodiment, the advantage of the countermeasure against line crawling has been shown only for common inversion driving at 3:1 interlaced scanning. In addition to 3:1 interlaced scanning, 4:1 interlaced scanning, 5:1 interlaced scanning, and others can also be applied.

In addition to the arrangement of the contact holes, described in the above embodiments, appropriately modified arrangement can be used, and the arrangement can, for example, be linked to that of the switching devices.

What is claimed is:

1. A liquid-crystal display apparatus comprising:

a liquid crystal sandwiched between a pair of substrates;

a plurality of signal lines and a plurality of scanning lines arranged in a matrix on one of the substrates;

a plurality of pixels each pixel having a plurality of dots, a plurality of first electrodes and a plurality of second electrodes, wherein the number of dots in each pixel corresponds to a number of basic colors used in the display apparatus and wherein the number of first electrodes and the number of second electrodes in each pixel is equal to the number of dots in such pixel and wherein each of the second electrodes within each pixel are arranged to overlie each of the first electrodes in their associated pixel;

an insulation layer disposed between the first and second electrodes, the insulation layer having a plurality of holes provided therein to permit the second electrodes to be electrically coupled to associated first electrodes, wherein each second electrode is electrically connected with only a single one of the first electrodes and each first electrode is electrically connected with only a single one of the second electrodes; and a plurality of switching devices, each switching device being arranged to be electrically connected with an associated first electrode, an associated scanning line and an associated signal line and wherein at least one of the switching devices and at least one of the second electrodes are stacked over one another and the number of switching devices which overlap with each second electrode is the same for all the second electrodes, wherein a corresponding one of the first electrodes and a corresponding one of the second electrodes which are electrically coupled by one of the holes have two longitudinal directions which are perpendicular with each other, and wherein, in each dot, a signal sub-line branched from each signal line and extending to an end of the dot in the direction in which the scanning lines are extended is provided, and the switching device provided for the dot is electrically connected to the signal sub-line.

2. A liquid-crystal display apparatus comprising:

a liquid crystal sandwiched between a pair of substrates;

a plurality of signal lines and a plurality of scanning lines arranged in a matrix on one of the substrates;

a plurality of pixels each pixel having a plurality of dots, a plurality of first electrodes and a plurality of second electrodes, wherein the number of dots in each pixel corresponds to a number of basic colors used in the display apparatus and wherein the number of first electrodes and the number of second electrodes in each pixel is equal to the number of dots in such pixel and wherein each of the second electrodes within each pixel are arranged to overlie each of the first electrodes in their associated pixel;

an insulation layer disposed between the first and second electrodes, the insulation layer having a plurality of holes provided therein to permit the second electrodes to be electrically coupled to associated first electrodes, wherein each second electrode is electrically connected with only a single one of the first electrodes and each first electrode is electrically connected with only a single one of the second electrodes; and a plurality of switching devices, each switching device being arranged to be electrically connected with an associated first electrode, an associated scanning line and an associated signal line and wherein at least one of the switching devices and at least one of the second electrodes are stacked over one another and the number of switching devices which overlap with each second electrode is the same for all the second electrodes, wherein a corresponding one of the first electrodes and a corresponding one of the second electrodes which are electrically coupled by one of the holes have two longitudinal directions which are perpendicular with each other, and wherein, in each pixel, a signal sub-line extending over a plurality of dots in the pixel in a stair-like manner, and a plurality of switching devices provided for the pixel is electrically connected to the signal sub-line.

3. A liquid-crystal display apparatus comprising:

a liquid crystal sandwiched between a pair of substrates;

a plurality of signal lines and a plurality of scanning lines on one of the substrates, wherein the scanning lines are arranged in a plurality of scanning-line groups;

a plurality of pixels each pixel having a plurality of dots, a plurality of first electrodes and a plurality of second electrodes, wherein the number of dots in each pixel corresponds to a number of basic colors used in the display apparatus and wherein the number of first electrodes and the number of second electrodes in each pixel is equal to the number of dots in such pixel and wherein each of the second electrodes within each pixel are arranged to overlie each of the first electrodes in their associated pixel;

an insulation layer disposed between the first and second electrodes, the insulation layer having a plurality of holes provided therein to permit the second electrodes to be electrically coupled to associated first electrodes, wherein each second electrode is electrically connected with only a single one of the first electrodes and each first electrode is electrically connected with only a single one of the second electrodes;

a plurality of thin-film transistors, each thin-film transistor being associated with a dot and driven by an associated signal line and an associated scanning-line group; and a plurality of selection circuits, each selection circuit electrically connected with an associated thin-film transistor, an associated scanning-line group, a plurality of inputs and one output, wherein a corresponding one of the first electrodes and a corresponding one of the second electrodes which are electrically coupled by one of the holes have two longitudinal directions which are perpendicular with each other, wherein the plurality of inputs of each of the selection circuits is connected with different scanning lines within its associated scanning-line group and the output is connected with a gate electrode of the thin-film transistor, and whereby the thin film transistors of adjacent dots within the same pixel are arranged to be scanned in different scanning periods.

4. A liquid-crystal display apparatus according to claim 3, wherein a scanning-line group comprises two scanning lines, and the selection circuit having the plurality of inputs and one output is a selection circuit having two inputs and one output.

* * * * *